US007205082B2

(12) United States Patent
Matsushima et al.

(10) Patent No.: US 7,205,082 B2
(45) Date of Patent: Apr. 17, 2007

(54) ELECTROSTATIC CHARGE IMAGE DEVELOPING TONER

(75) Inventors: Asao Matsushima, Hachioji (JP); Shiro Hirano, Hachioji (JP); Naohiro Hirose, Hachioji (JP); Ken Ohmura, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 314 days.

(21) Appl. No.: 10/795,702

(22) Filed: Mar. 8, 2004

(65) Prior Publication Data

US 2004/0265719 A1 Dec. 30, 2004

(30) Foreign Application Priority Data

Jun. 27, 2003 (JP) ..... 2003-184447

(51) Int. Cl.
*G03G 9/08* (2006.01)

(52) U.S. Cl. ..... 430/108.5; 430/108.1

(58) Field of Classification Search ..... 430/108.5, 430/108.1

See application file for complete search history.

(56) References Cited

U.S. PATENT DOCUMENTS

| | | | | |
|---|---|---|---|---|
| 6,749,980 | B2 * | 6/2004 | Cheng et al. | 430/137.14 |
| 2003/0186150 | A1 * | 10/2003 | Kitani et al. | 430/108.3 |
| 2004/0202952 | A1 * | 10/2004 | Albright et al. | 430/137.14 |

FOREIGN PATENT DOCUMENTS

| | | |
|---|---|---|
| JP | 60-083039 | 5/1985 |
| JP | 4-30581 | 5/1992 |
| JP | 9-15902 | 1/1997 |
| JP | 11-194540 | 7/1999 |

* cited by examiner

*Primary Examiner*—John L Goodrow
(74) *Attorney, Agent, or Firm*—Lucas & Mercanti, LLP

(57) ABSTRACT

An electrostatic charge image developing toner having: a toner particle having a colorant and a resin; and a surfactant having two or more anionic groups within one molecule in an amount of 10 ppm to 10,000 ppm.

7 Claims, 2 Drawing Sheets

ROUND
TONER PARTICLE

ANGULAR
TONER PARTICLE

ANGULAR
TONER PARTICLE

ELECTROSTATIC CHARGE IMAGE DEVELOPING TONER

BACKGROUND OF THE INVENTION

1. Field of the Invention

The present invention relates to an electrostatic charge image developing toner.

2. Description of the Related Art

Nowadays, electrostatic latent image development method is widely adapted to image formation process using printer, copying machine, facsimile and so forth.

This is because the method has a high degree of completion which can ensure rapid and stable formation of high-quality image. Several problems, however, still remain unsolved.

For example, it is difficult for an earlier developed toners prepared by the grinding process to keep an inter-particle uniformity in the surface property due to non-uniform distribution of materials dispersed in the toner on the fractured surface, and this tends to cause non-uniformity in the transfer process, and to thereby degrade the color reproducibility in color images.

On the other hand, another demand for the electrostatic latent image toner is to reduce the particle size in view of upgrading the image quality. Extensive efforts for producing small-particle-size toner have recently been directed to development of "chemical toner", of which particle is formed in a water-base medium. Methods of preparing the chemical toner include those such as preparing irregular-shaped toner particle by allowing resin particle and optional colorant to proceed association, salting-out, coagulation or fusing; and such as dispersing a radical polymerizable monomer and colorant and then allowing the mixture to proceed droplet dispersion in a water-base medium so as to obtain a desired particle size, and allowing the dispersion to proceed emulsion polymerization.

The toner particle obtained by the emulsion polymerization process is advantageous in raising inter-particle uniformity in shape because the process is successful in forming the toner particle having a spherical shape and a uniform surface property, but the particle distribution size is wide, resulting in raising a problem of degrading the cleaning property or causing a toner dispersion.

As one measure for addressing this problem, a spherical particle produced by treating a resin particle, prepared in a water-base medium containing a surfactant, with a coagulant in an amount larger than the critical coagulation concentration of the resin particle and an organic solvent freely miscible with water (see e.g., JP-Tokukaihei-11-194540A).

An emulsion-polymerized toner (see e.g., JP-1744009B) and fusion emulsification process (see e.g., JP-Tokukaihei-9-15902A), which are based on a technique of mechanically dispersing a monomer oil droplet or resin solution droplet under the presence of an inorganic dispersant, can only attain a particle size of as small as 7 μm, and are therefore not suitable for obtaining a sharp particle size distribution in principle. Use of a surfactant is indispensable for forwarding size reduction of the toner particle. Although most portion of an unnecessary residue of the surfactant in this case can be removed when the particle is separated from the water-base medium, problems may arise in that the surfactant still remaining in the particle inhibits electrostatic charging of the toner depending on types and residual amount of the surfactant, or in that the surfactant reacts with a metal ion contained in a pigment so as to form an insoluble salt, and the resultant salt is causative of contamination of a friction electrostatic charging member or a photosensitive material, or inhibition of the toner particle per se.

SUMMARY OF THE INVENTION

It is therefore an object of the present invention to provide an electrostatic charge image developing toner excellent in transparency of image, not causative of filming of the photo-sensitive material, always showing a sharp distribution of amount of charge irrespective of moisture environment, capable of producing high-definition and high-quality image, excellent in handleability in the maintenance, and excellent in rise-up and stability of charging.

In accordance with a first aspect of the present invention, the electrostatic charge image developing toner comprises:

a toner particle having a colorant and a resin; and a surfactant having two or more anionic groups within one molecule in an amount of 10 ppm to 10,000 ppm.

Preferably, in the toner of the first aspect of the present invention, any one of the anionic groups comprises a sulfonic acid group or a salt of the sulfonic acid group.

Preferably, in the toner of the first aspect of the present invention, a coefficient of variation of shape factor of the particle is 16% or less, and a coefficient of variation of number-average particle diameter is 27% or less.

Preferably, in the toner of the first aspect of the present invention, the surfactant comprises a compound expressed by a general formula (1):

General formula (1)

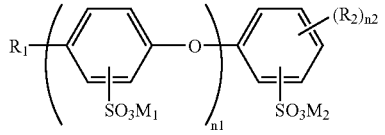

[in the general formula (1), $R_1$ represents a $C_{8-12}$ alkyl group, $R_2$ represents a hydrogen atom or substituent, $M_1$ and $M_2$ respectively represent a monovalent metal element or ammonium ion, n1 is an integer of 1 to 6, and n2 is an integer of 1 to 4.]

Preferably, in the toner of the first aspect of the present invention, the surfactant comprises a compound expressed by a general formula (2):

General formula (2)

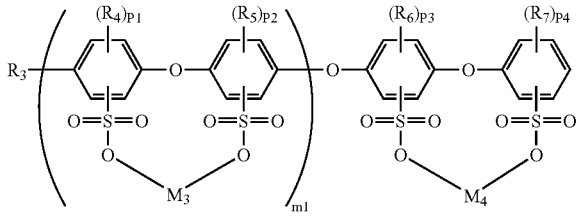

[in the general formula (2), $R_3$ represents a $C_{8-12}$ alkyl group, $R_4$, $R_5$, $R_6$ and $R_7$ respectively represent a hydrogen atom or substituent, m1 is an integer of 1 to 5, $M_3$ and $M_4$ respectively represent a divalent metal element, p1 to p3 respectively represent an integer of 1 to 3, and p4 is an integer of 1 to 4].

Preferably, the above described toner may be manufactured by the method which comprises:

allowing a resin particle and colorant particle to coagulate and fuse in a water-base medium comprising at least one species of a surfactant expressed by the general formulae (1) or (2);

separating a coagulated and fused particle by solid-liquid separation; and washing and drying a separated particle.

Preferably, the above described toner may be manufactured by the method which comprises:

preparing a colorant particle dispersion by dispersing a colorant particle in a water-base medium comprising at least one species of a surfactant expressed by the general formulae (1) or (2);

mixing the colorant particle dispersion with a resin particle dispersion comprising a resin particle; and allowing the colorant particle and the resin particle to coagulate and fuse.

Preferably, the above described toner may be manufactured by the method which comprises:

preparing a resin particle dispersion by dispersing a resin particle in a water-base medium comprising at least one species of surfactant expressed by the general formulae (1) or (2);

mixing the resin particle dispersion with a colorant particle dispersion comprising a colorant particle; and allowing the colorant particle and the resin particle to coagulate and fuse.

The toner of the present invention is excellent in transparency of image, not causative of filming of the photosensitive material, less environmental difference in charging, always showing a sharp distribution of amount of charge irrespective of moisture environment, capable of producing high-definition and high-quality image, excellent in handleability in the maintenance.

Moreover, the toner of the present invention shows an excellent rise-up and a stable charging even in an extremely small-sized developing vessel, enabling to always stably output a high quality image irrespective of variation of a condition, density and pixel area ratio of image output.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein.

DETAILED DESCRIPTION OF THE PREFERRED EMBODIMENT

Figure 1A:
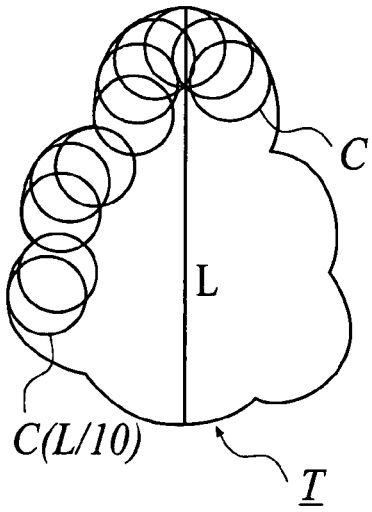
FIG. 1A is an explanatory view of a projected image of a rounded toner particle.

The following paragraphs will detail the present invention.

In the process of thorough examination of the above-described problems, the present inventors prepared an electrostatic charge image developing toner, containing a toner particle which comprises a colorant and a resin, so as to contain a surfactant having two or more anionic groups within one molecule in an amount of 10 ppm to 10,000 ppm, and succeeded in obtaining an electrostatic charge image developing toner excellent in rise-up property and stability of electrostatic charging, capable of producing image having a desirable transparency, not causative of filming of the photosensitive material, always showing a sharp distribution of amount of charge irrespective of humidity environment, capable of producing high-definition and high-quality image, and excellent in handleability in the maintenance.

Reasons for the success the present inventors found out are that the surfactant used in the present invention is not causative of inhibition of the electrostatic charging or leakage of the electrostatic charge, unlike the previously known surfactant, and conversely has an excellent "charge control function" which stabilizes electrostatic charging of the toner, and that manufacture of the toner particle produces only an extremely small amount of insoluble byproducts ascribable to reaction with various metal elements and so forth. It is considered that these factors successfully resulted in the above-described effect of the present invention.

The surfactant different from that used in the present invention, in particular a polymerized toner produced by emulsion association, suffers from a problem that the dispersion of the colorant in a publicly-known surfactant solution tends to leave a slight amount of coarse colorant particle coagulate despite every possible effort of dispersion of the colorant.

This sort of coarse colorant particle coagulate is not incorporated inside the toner particle, but instead remains on the surface of the toner particle even after the washing. It is pointed out that this is causative of insufficient electrostatic charging, filming on the photosensitive material, non-uniform distribution of the colorant particle in the toner particle, and tends to induce degradation of transparency of images and transmissivity of OHT.

Any free colorant may adhere on clothes and human body during maintenance time such as refilling the toner and may readily stain them. The stain is often very tough against washing with any surfactant and hard to remove.

A publicly-known alkylbenzene-sulfate-base surfactant tends to produce a trace amount of insoluble salt of the surfactant during dispersion of the colorant, and it is known to raise a serious problem that adhesion of the salt on the surface of the toner particle may induce inhibition of electrostatic charging, may broaden distribution of amount of charge of the toner, and may consequently degrade definition and quality of images. The surfactant used in the present invention is also found to have an improving effect over these problems, in addition to the described effect of the present invention. In the present invention, the surfactant having two or more anionic groups within one molecule has any of sulfonic acid group, salt of sulfonic acid group, sulfate ester group, salt of sulfate ester group, phosphoric acid group and carboxylic group as the anionic group, and examples of this sort of surfactant include compounds expressed by the general formula (1), or those expressed by the general formula (2).

<<Compounds (Surfactants) Expressed by General Formula (1) or (2)>>

In the process of manufacturing the electrostatic charge image developing toner of the present invention, the compounds expressed by the general formula (1) or (2) are used in preparation of the dispersion of the resin particle, preparation of the dispersion of the colorant particle, formation of coloring particle by fusing the resin particle and colorant particle, and so forth, and characterized in that they remain in the final form of the toner even after the coloring particle is added with external additives and thereby the toner particle is formed.

Next paragraphs will describe the compounds (also referred to as surfactant) expressed by the general formula (1).

Examples of the $C_{8-12}$ alkyl group expressed by $R_1$ include n-octyl group, n-nonyl group, n-decyl group, n-undecyl group and n-dodecyl group, where both of straight-chained and branched groups allowable.

Examples of the substituent expressed by $R_2$ include alkyl group (e.g., methyl group, ethyl group, propyl group, isopropyl group, tert-butyl group, pentyl group, hexyl group, octyl group, dodecyl group, tridecyl group, tetradecyl group, pentadecyl group, or the like); cycloalkyl group (e.g., cyclopentyl group, cyclohexyl group, or the like); phosphino group (e.g., dimethylphosphino group, diphenylphosphino group, methylphenoxyphosphino group, or the like); phosphinyl group (e.g., phosphinyl group, dioctyloxyphosphinyl group, diethoxyphosphinyl group, or the like), phosphinyloxy group (e.g., diphenoxyphophinyloxy group, dioctyloxyphosphinyloxy group); phophinylamino group (e.g., dimethoxyphosphinylamino group, dimethylaminophosphinylamino group, or the like); silyl group (e.g., trimethylsilyl group, tert-butyl dimethylsilyl group, phenyl dimethylsilyl group, or the like); cyano group; nitro group; hydroxyl group; sulfo group; carboxyl group, or the like.

For the case where two or more groups expressed by $R_2$ exist, the individual groups expressed by $R_2$ may be identical or may differ from each other. In the groups respectively expressed by $SO_3M_1$ and $SO_3M_2$ in the general formula (1), monovalent metal elements expressed by $M_1$ and $M_2$ are exemplified by sodium, potassium, lithium and so forth, and among others, sodium is preferably used. The metal elements expressed by $M_1$ and $M_2$ may be identical or may differ from each other.

In the general formula (1), n1 is an integer of 1 to 6, and more preferably an integer of 1 to 3.

Next paragraphs will describe the compounds expressed by the general formula (2).

The $C_{8-12}$ alkyl group expressed by $R_3$ is identical to the $C_{8-12}$ alkyl group expressed by $R_1$ in the general formula (1).

The substituent respectively expressed by $R_4$, $R_5$, $R_6$ and $R_7$ are identical to those expressed by $R_2$ in the general formula (1).

m1 is an integer of 1 to 5; p1 to p3 respectively represent an integer of 1 to 3; and p4 is an integer of 1 to 4.

Examples of the divalent metal elements respectively expressed by $M_3$ and $M_4$ include beryllium, magnesium, calcium and so forth, where calcium and magnesium are more preferable, and among others calcium is most preferably used.

Specific examples of the compound (surfactants) expressed by the general formula (1) or (2) in the present invention will be described later, where it is to be understood that these examples by no means limit the present invention.

Compound 1

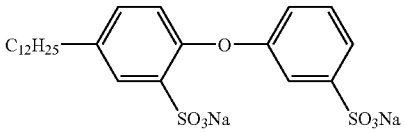

Compound 2

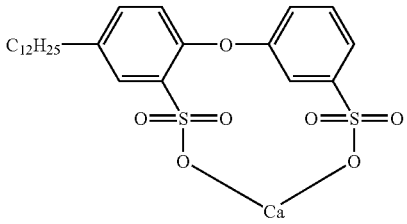

Compound 3

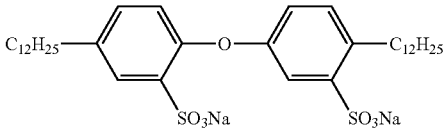

Compound 4

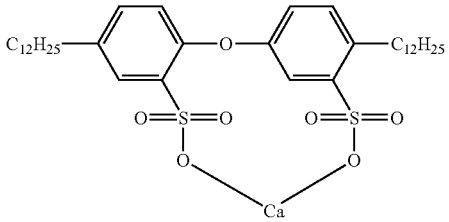

Compound 5

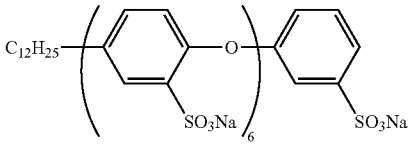

Compound 6

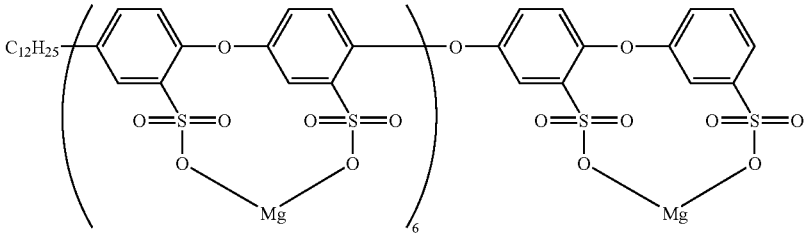

The content of the surfactant, having two or more anionic groups in one molecule and the compound expressed by the general formula (1) or (2), is essentially specified as 10 ppm to 10,000 ppm, where it is more specifically 100 ppm to 8,000 ppm, and still more specifically 450 ppm to 6,400 ppm.

Means for adjusting the content of the compound expressed by the general formula (1) or (2), which is a specific example of the surfactant having two or more anionic groups in one molecule and is contained in the electrostatic charge image developing toner of the present invention, within the above-described range includes (a) preparation of latex, (b) content of the colorant during the dispersion, (c) adjustment of washing conditions during the preparation of the coloring particle, (d) selection of an appropriate strategy from addition after the preparation of the coloring particle, toner or developing agent, or the like. Among them, the content of the compound is preferably adjusted by (b) content of the colorant during the dispersion in view of raising transparency of the toner.

By allowing the toner of the present invention to contain the compound expressed by the general formula (1) or (2), which is a specific example of the surfactant having two or more anionic groups, in an amount as specified in the above-described range, it is made possible not only to obtain the effects of the present invention, but also to obtain a subsidiary effect that electrostatic charging property of the toner becomes not susceptible to the environment, so that the charge is always given and kept in a uniform and stable manner.

The surfactant used in the present invention preferably contains an inorganic salt in an amount of 0.1% by mass to 5% by mass under a moisture content of 53% in view of improving controllability of electrostatic charging of the toner, more preferably in an amount of 1% by mass to 3% by mass. The content of the inorganic salt in the surfactant is determined by subjecting a methanol insoluble matter in the surfactant to an atomic absorption analysis or the like.

In the process of allowing the resin particle and colorant particle to coagulate and fuse in a water-base medium containing at least one species of the surfactant expressed by the general formula (1) or (2), it is also preferable that a 10%-by-mass aqueous solution of the surfactant shows a pH value of 8 to 11, in view of raising the dispersibility of the colorant within the resultant coagulated and fused particle.

The following paragraphs will describe a method of measuring the content-in-toner of the compound expressed by the general formula (1) or (2), which is a specific example of the surfactant having two or more anionic groups in one molecule and is contained in the electrostatic charge image developing toner of the present invention.

<<Measurement of Content of Surfactant in Toner>>

In the measurement of the content of the compound expressed by the general formula (1) or (2), which is a specific example of the surfactant having two or more anionic groups in one molecule and is contained in the electrostatic charge image developing toner of the present invention, 1 g of the toner is first dissolved in 50 ml of chloroform, the surfactant is extracted from the chloroform phase using 100 ml of ion-exchanged water, the chloroform phase is washed again using 100 ml of ion-exchanged water, the combined extract (aqueous phase) of 200 ml in total is diluted to 500 ml, the diluted solution as a test solution is allowed to develop color using Methylene Blue according to a method specified by JIS 33636, absorbance of the test solution is measured, and the content-in-toner is determined using a separately prepared analytical curve.

The structure of the surfactant expressed by the general formula (1) or (2) is determined by analyzing the above-obtained extract by $^{1}$H-NMR (also combined with $^{13}$C-NMR, etc.).

In the process of causing salting-out, coagulation and fusion of the resin particle from the resin particle dispersion prepared in a water-base medium in the present invention, monovalent, divalent or trivalent metal salt is preferably used as a coagulant, where divalent or trivalent metal salt is more preferably used. This is because the divalent or trivalent metal salt has a smaller critical coagulation concentration (coagulation value or coagulation point) than that of the monovalent metal salt, thereby proceeding the process efficiently with a small amount.

The next paragraphs will describe the metal salt used as a coagulant or coagulation terminator in the present invention.

Available examples of the metal salt include salts of monovalent metal which is exemplified by alkali metals such as sodium, potassium and lithium; salts of divalent metal which is exemplified by alkali earth metals such as calcium and magnesium, or by manganese and copper; and salts of trivalent metal which is exemplified by iron and aluminum. More specific examples of these metal salts are listed below.

Specific examples of the metal salt of monovalent metal include sodium chloride, potassium chloride, lithium chloride or the like. Examples of the metal salt of divalent metal include magnesium chloride, calcium chloride calcium nitrate, zinc chloride, copper sulfate, magnesium sulfate, manganese sulfate or the like. Examples of the metal salt of trivalent metal include aluminum chloride, iron chloride or the like. Other examples include poly(aluminum hydroxide), poly(aluminum chloride) and polymer coagulant. These may properly be selected depending on purpose of use.

The critical coagulation concentration is an index regarding stability of the dispersed matter in the water-base dispersion medium, and indicates a concentration at which the coagulation occurs upon addition of a dispersant. The critical coagulation concentration largely varies depending on the latex per se and dispersant. This is detailed in Seizo Okamura, et al., Kobunshi-Kagaku (Polymer Chemistry) 17, 601 (1960), for example, where specific values are found in the description of the literature.

In another possible method of estimating the critical coagulation concentration, a target particle dispersion liquid is added with various concentrations of a desired salt, and the dispersion liquid is then measured for its $\zeta$ potential, to thereby define a salt concentration where the $\zeta$ potential starts changing as the critical coagulation concentration.

The polymer fine particle dispersion is treated using the above-described metal salt in the present invention so as to attain a concentration equal to or higher than the critical coagulation concentration. In this case, whether the metal salt is added directly or added in a form of aqueous solution can, of course, arbitrarily be selected depending on purposes. For the case where the addition in a form of aqueous solution is selected, the added metal salt must keep a concentration equal to or higher than the critical coagulation concentration in the total volume of the polymer particle dispersion and the aqueous metal salt solution.

Concentration of the metal salt used as a coagulant may be set equal to or higher than the critical coagulation concentration, where the concentration of 1.2 times or more, and more preferably 1.5 times or more as high as the critical coagulation temperature is preferable.

For the case where the coagulant is added to a dispersion liquid in which a composite resin particle (particle having a multi-layered configuration or particle containing other constituent such as additives are referred to as "composite resin particle") or a colorant particle is dispersed, temperature of the dispersion liquid is preferably set lower than the glass transition point (Tg) of the composite resin particle, and specifically set within a range from 5 to 55° C., and more preferably from 10° C. to 45° C.

If the temperature of the dispersion liquid at the time of addition of the coagulant is not lower than the glass transition point (Tg) of the composite resin particle, it may become difficult to control the particle diameter, and a giant particle tends to be produced.

In the process of salting-out, coagulation and fusion, it is preferable that the coagulant is added to the dispersion liquid under stirring when the temperature of the dispersion liquid in which the composite resin particle and colorant particle are dispersed is lower than the glass transition point (Tg) of the composite resin particle, and that the heating of the dispersion liquid is then immediately started to thereby raise the temperature equal to or higher than the glass transition point (Tg) of the composite resin particle.

In the present invention, the colored particle (referred to as "toner particle" in the present invention) is obtained by allowing the resin particle and colorant to salt, coagulate and fuse in a water-base medium, and the toner particle is then separated from the water-base medium, where the separation is preferably proceeded at a temperature equal to or higher than Krafft point of the surfactant present in the water-base medium, and more preferably within a range from Krafft point to (Krafft point+20° C.).

The above-described Krafft point refers to a temperature at which a surfactant-containing aqueous solution starts to cloud. Krafft point can be measured as described in the next.

<<Measurement of Krafft Point>>

The coagulant in an amount of practical use was added to the water-base medium, or surfactant solution, which is used in the process of salting-out, coagulation and fusion, and the resultant solution was stored at 1° C. for 5 days. The solution is then gradually heated under stirring until it becomes clear. A temperature at which the solution became clear was defined as Krafft point.

The electrostatic charge image developing toner of the present invention preferably contains the above-described metal element (in a form of metal, metal ion and so forth) in an amount of 250 ppm to 20,000 ppm, and more preferably 800 ppm to 5,000 ppm, in view of suppressing excessive charging of the toner particle and of providing a uniform charging property, and in particular of stabilizing and keeping the charging property against environment.

In the present invention, it is also preferable that the divalent (trivalent) metal element used as the coagulant and monovalent metal element added as a coagulation terminator described later are used in an amount of 350 ppm to 35,000 ppm in total.

Amount of residual metal ion in the toner can be determined by using fluorescent X-ray analyzer "System 3270" (product of Rigaku Denki Kogyo K. K.), by which intensity of fluorescent X-ray emitted from a metal species of the metal salt used as the coagulant (e.g., calcium derived from calcium chloride) is measured. In a specific procedures for the measurement, a plurality of toners respectively having known contents of the coagulant metal salt are obtained, 5 g of each toner is pelletized, and a relation (analytical curve) between the content of the coagulant metal salt (ppm by mass) and fluorescent X-ray intensity (peak intensity) ascribable to the metal species of the metal salt is measured. Next, the toner (sample) of which content of the coagulant metal salt is to be measured is similarly pelletized, and florescent X-ray intensity ascribable to the metal species of the coagulant metal salt is measured. This makes it possible to determine the content, or "amount of residual metal ion in the toner".

<<Method of Manufacturing Electrostatic Charge Image Developing Toner>>

A method of manufacturing the electrostatic charge image developing toner of the present invention will be explained in the next.

The toner of the present invention is manufactured by forming the composite resin particle under the absence of the colorant, adding the dispersion of the colorant particle to the dispersion of the composite resin particle, and subjecting the composite resin particle and colorant particle to salting-out, coagulation and fusion.

As a means for allowing the surfactant having two or more anionic groups in one molecule to be contained in an amount of 10 ppm to 10,000 ppm in the toner of the present invention, it is preferable to add the surfactant in any one stage of the aforementioned manufacturing process.

Preparation of the composite resin particle proceeded under the absence of the colorant is successful in preventing the polymerization reaction for obtaining the composite resin particle from being inhibited. The toner of the present invention therefore can keep an excellent anti-offset property without being degraded, and is not causative of contamination of the fixation device or staining of the image due to accumulation of the toner.

Because the polymerization reaction for obtaining the composite resin particle can thoroughly be proceeded, the obtained toner particle will have no monomer or oligomer remaining therein, and is consequently not causative of producing an offensive odor during the heat fixation process in the image forming method using the toner.

The obtained toner particle has a uniform surface characteristics, and can ensure a sharp distribution of the amount of electrostatic charging, so that it can form image having an excellent sharpness for a long duration of time.

The "composite resin particle" composing the toner of the present invention herein is defined as a multi-layered resin particle in which two or more coating layers made of resin which is different in a molecular weight and/or composition from those of the resin composing a core particle are formed, to cover the surface of the core particle. Hereupon, the "composite resin particle" is the term to express a concept imagined from the manufacturing method, therefore, it is to be understood that all the particles are not necessarily compounded in the real condition.

A "central portion (core)" of the composite resin particle herein means a "core particle" composing the composite resin particle.

An "outer layer (shell)" of the composite resin particle herein means the outermost layer of the "one or two or more coating layers" composing the composite resin particle.

An "intermediate layer" of the composite resin particle herein means a coating layer formed between the central portion (core) and the outer layer (shell).

Describing now about one specific example of the method of manufacturing the electrostatic charge image developing toner of the present invention, the method comprises:

(1) a multi-step polymerization process (I) for obtaining the composite resin particle prepared so that a resin particle, preferably a mold releasing agent and/or crystalline polyester is contained in area other than the outermost layer (central portion or intermediate layer);
(2) a salting-out/coagulation/fusion process (II) for obtaining the toner particle by subjecting the composite resin particle and colorant particle to salting-out, coagulation and fusion;
(3) a filtration-washing process (III) for removing the surfactant or the like from the toner particle by filtering the toner particle out from the dispersion system of the toner particle;
(4) a drying step for drying the toner particle after the washing; and
(5) a step for adding any external additive to the dried toner particle.

The individual steps will be described in the next.

<<Process of Manufacturing Composite Resin Particle>>

The multi-step polymerization process (I) is a step for manufacturing the composite resin particle based on the multi-step polymerization process by which the coating layer (n+1) composed of a polymer of the monomer (n+1) is formed on the surface of the resin particle (n). It is preferable herein to adopt the multi-step polymerization process having three or more polymerization steps from the viewpoint of stability in the manufacture and crushing strength of the obtained toner.

The next paragraphs will describe the two-step polymerization process and three-step polymerization process, which are representative processes of the multi-step polymerization process.

<<Description of Two-Step Polymerization Process>>

One example of a two-step polymerization process will be explained. The two-step polymerization process is a method of manufacturing the composite resin particle which comprises the central portion (core) composed of a high-molecular-weight resin containing a mold releasing agent, and the outer layer (shell) composed of a low-molecular-weight resin. That is, the composite resin particle obtained by the two-step polymerization process comprises one core and one coating layer.

Describing now specifically about the method, first the mold releasing agent is dissolved in a monomer (H), the obtained monomer solution is dispersed into a water-base medium (aqueous solution of the surfactant) in a form of oil droplet, and the obtained system is subjected to polymerization (first-step polymerization) to thereby prepare a dispersion of a high-molecular-weight resin particle (H) containing the mold releasing agent.

Next, the dispersion liquid of the resin particle (H) is added with a polymerization initiator and a monomer (L) for obtaining the low-molecular-weight resin, and the mixture is subjected to polymerization (second-step polymerization) of the monomer (L) under the presence of the resin particle (H) to thereby form the coating layer (L) composed of the low-molecular-weight resin (polymer of the monomer (L)) on the surface of the resin particle (H).

<<Description of Three-Step Polymerization Process>>

The three-step polymerization process is a process of manufacturing the composite resin particle which comprises the central portion (core) composed of a high-molecular-weight resin, the intermediate layer containing a mold releasing agent, and the outer layer (shell) composed of a low-molecular-weight resin. That is, the composite resin particle obtained by the three-step polymerization process comprises one core and two coating layers.

Describing now specifically about the method, a dispersion of the resin particle (H) obtained by the polymerization (first-step polymerization) according to the ordinary method is added to the water-base medium (aqueous solution of the surfactant), the water-base medium is further added with the monomer solution containing the mold releasing agent dissolved into the monomer (M) so as to form a oil droplet dispersion, and the obtained system is subjected to polymerization (second-step polymerization) to thereby prepare a dispersion of a composite resin particle [high-molecular-weight resin (H)/intermediate-molecular-weight resin (M)] which comprises the resin particle (H) (core particle) and a coating layer (M) (intermediate layer) composed of the mold-releasing-agent-containing resin (polymer of the monomer (M)) formed on the surface thereof.

Next, the dispersion liquid of the composite resin particle is added with a polymerization initiator and a monomer (L) for obtaining the low-molecular-weight resin, and the mixture is subjected to polymerization (second-step polymerization) of the monomer (L) under the presence of the composite resin particle to thereby form the coating layer (L) composed of the low-molecular-weight resin (polymer of the monomer (L)) on the surface of the composite resin particle.

In the process of forming the coating layer (M) on the surface of the resin particle (H) in the three-step polymerization process, the mold releasing agent can finely and uniformly be dispersed by adopting the procedures that the dispersion liquid of the resin particle (H) is added to the water-base medium (aqueous solution of the surfactant), and the monomer solution prepared by dissolving the mold releasing agent in the monomer (M) is then dispersed into the water-base medium in a form of oil droplet, and the obtained system is subjected to polymerization (second-step polymerization).

It is to be noted now that either of the addition of the dispersion liquid of the resin particle (H) and oil-droplet dispersion of the monomer solution may precede the other, or the both may simultaneously be carried out as explained below.

That is, possible procedures include:

(a) an embodiment in which, in the process of forming the intermediate layer composing the composite resin particle, the resin particle which later becomes the central portion (core) of the composite resin particle is added to an aqueous solution of the surfactant; a monomer composition containing the mold releasing agent/crystalline polyester is dispersed in thus-obtained aqueous solution; and the resultant system is then allowed to polymerize;
(b) an embodiment in which, in the process of forming the intermediate layer composing the composite resin particle, a monomer composition containing the mold releasing agent/crystalline polyester is dispersed in an aqueous solution of the surfactant; the resin particle which later becomes the central portion (core) of the composite resin particle is added to thus-obtained aqueous solution; and the resultant system is then allowed to polymerize; and
(c) an embodiment in which, in the process of forming the intermediate layer composing the composite resin particle, the resin particle which later becomes the central portion (core) of the composite resin particle is added to an aqueous solution of the surfactant; and at the same time, the monomer composition containing the mold releasing agent/crystalline polyester is dispersed in thus obtained aqueous solution; and the resultant system is then allowed to polymerize.

One possible method of forming the resin particle (core particle) containing the mold releasing agent or of forming the coating layer (intermediate layer) is such as dissolving the mold releasing agent into the monomer, dispersing the obtained monomer solution into the water-base medium in a form of oil droplet, and allowing the resultant system to polymerize, to thereby produce a composite resin particle.

The "water-base medium" herein means a medium which comprises 50% by mass to 100% by mass of water, and 0% by mass to 50% by mass of a water-soluble organic solvent. Examples of the water-soluble organic solvent include methanol, ethanol, isopropanol, butanol, acetone, methyl ethyl ketone and tetrahydrofuran, where alcohol-base organic solvent incapable of dissolving the obtained resin is preferable.

One preferable polymerization method for forming the mold-releasing-agent-containing resin particle or the coating layer is such as dispersing the monomer solution, prepared by dissolving the mold releasing agent into the monomer, into the water-base medium having dissolved therein the surfactant in a concentration not larger than the critical micelle concentration, in a form of oil droplet with the aid of mechanical energy to thereby prepare the dispersion liquid, and thus obtained dispersion liquid is then added with a water-soluble polymerization initiator so as to proceed radical polymerization in the oil drop (referred to as "mini-emulsion process", hereinafter). It is also allowable to add an oil-soluble polymerization initiator into the monomer solution in place of, or in addition to, adding the water-soluble polymerization initiator.

The mini-emulsion process mechanically forming the oil droplet is successful in preventing the mold releasing agent dissolved in the oil phase from being eliminated, and in consequently introducing a sufficient amount of the mold releasing agent in the resultant resin particle or in the coating layer, unlike the general emulsion polymerization process.

A dispersion machine for enabling oil droplet dispersion with the aid of mechanical energy is not specifically limited, and examples of which include mechanical dispersion machine "CLEARMIX" (product of M-TECHNIQUE), ultrasonic dispersion machine, mechanical homogenizer; pressure dispersion machines such as Manton Gaulin and pressure homogenizer. The resultant dispersion diameter is preferably 10 nm to 1,000 nm, more preferably 50 nm to 1000 nm, and still more preferably 30 nm to 300 nm.

As the polymerization process for forming the mold-releasing-agent-containing resin particle or the coating layer, it is also allowable to adopt any other publicly-known methods such as emulsion polymerization process, suspension polymerization process, and seed polymerization process.

Particle diameter of the composite resin particle obtained in the polymerization process (I) preferably falls within a range from 10 to 1,000 nm on the weight average basis when measured using an electrophoretic light scattering photometer "ELS-800" (product of Otsuka Electronics Co., Ltd.)

Glass transition temperature (Tg) of the composite resin particle preferably falls within a range from 44° C. to 74° C., and more preferably 52° C. to 64° C. Softening point of the composite resin particle preferably falls within a range from 95° C. to 140° C.

<<Salting-Out/Coagulation/Fusion Process (II)>>

The salting-out/coagulation/fusion process (II) is a process for obtaining the irregular-shaped (aspherical) toner particle by subjecting the composite resin particle, obtained from the "Process of Manufacturing Composite Resin Particle", and the colorant particle to salting-out, coagulation and fusion (salting-out and fusion are allowed to occur at the same time).

In the salting-out/coagulation/fusion process (II), it is also allowable to subject other internal additive particle such as charge control agent (fine particle having a number-average primary particle diameter of as small as 10 nm to 1,000 nm) to salting-out, coagulation and fusion, together with the composite resin particle and colorant particle.

The colorant particle may be modified on its surface. Surface modifier available herein may be any of publicly-known agents.

The colorant particle is subjected to salting-out, coagulation and fusion as being dispersed in the water-base medium. The water-base medium in which the colorant particle is dispersed can be exemplified by an aqueous solution having the surfactant dissolved therein in a concentration higher than the critical micelle concentration (CMC).

The surfactant available herein may be same as that used in the multi-step polymerization process (I).

There is no special limitation on dispersion-machine used for the dispersion of the colorant particle, and preferable examples thereof include a mixing machine "CLEARMIX" (product of M-TECHNIQUE) having a rotor capable of rotating at high speed, ultrasonic dispersion machine, mechanical homogenizer, Manton Gaulin, pressurized dispersion machine such as pressure homogenizer, Getzmann mill and medium dispersion machine such as diamond fine mill.

It is preferable that the above-described dispersion of the colorant particle is carried out under the presence of the surfactant having two or more anionic groups in one molecule as specified in the present invention.

In the salting-out, coagulation and fusion of the composite resin particle and colorant particle, it is preferable to add a coagulant in a concentration not lower than the critical micelle concentration to the dispersion liquid containing the composite resin particle and colorant particle dispersed therein, and to heat the dispersion liquid to a temperature not lower than the glass transition temperature (Tg) of the composite resin particle.

In the aforementioned salting-out/coagulation/fusion process of the composite resin particle and colorant particle, it is also allowable to use the surfactant having two or more anionic groups in one molecule as specified in the present invention.

It is still more preferable to use a coagulation terminator at the timing when the composite resin particle achieves a desired diameter with the aid of the coagulant. The coagulation terminator is preferably a monovalent metal salt, and more preferably sodium chloride.

A desirable temperature range for the salting-out, coagulation and fusion is (Tg+10) to (Tg+50)° C., more preferably (Tg+15) to (Tg+40)° C. It is also allowable to add an organic solvent freely miscible with water for the purpose of effectively proceeding the fusion.

The "coagulant" used for the salting-out, coagulation and fusion can be exemplified by alkali metal salts and alkali earth metals as described in the above.

The salting-out and coagulation in the present invention will be explained in the next.

"Salting-out, coagulation and fusion" in the context of the present invention means that the salting-out (coagulation of the particles) and fusion (disappearance of the interface between particles) occur at the same time, or any action causing the salting-out and fusion at the same time.

To allow the salting-out and fusion to occur at the same time, it is preferable to induce coagulation of the particles (composite resin particle, colorant particle) under a temperature condition not lower than the glass transition temperature (Tg) of the resin composing the composite resin particle.

The electrostatic charge image developing toner of the present invention is preferably prepared by forming the composite resin particle under the absence of the colorant, adding the dispersion liquid of the colorant to the dispersion liquid of the composite resin particle, and then subjecting the composite resin particle and colorant particle to salting-out, coagulation and fusion.

Preparation of the composite resin particle proceeded under the absence of the colorant is successful in preventing the polymerization reaction for obtaining the composite resin particle from being inhibited. The toner of the present invention therefore can keep an excellent anti-offset property without being degraded, and is not causative of contamination of the fixation device or staining of the image due to accumulation of the toner.

Because the polymerization reaction for obtaining the composite resin particle can thoroughly be proceeded, the obtained toner particle will have no monomer or oligomer remaining therein, and is consequently not causative of producing an offensive odor during the heat fixation process in the image forming method using the toner.

The obtained toner particle has a uniform surface characteristics, and can ensure a sharp distribution of the amount of electrostatic charging, so that it can form image having an excellent sharpness for a long duration of time. In the image forming method including the fixation process based on the contact heating system, use of the toner having extremely small variations among the toner particles in their composition, molecular weight and surface characteristic is successful in improving anti-offset property and anti-wind-adhesion property while keeping a desirable adhesiveness (strong fixation strength) on the image support, and in obtaining image having an appropriate gloss.

The mold releasing agent available for the toner of the present invention will be explained in the next.

Content of the mold releasing agent composing the electrostatic charge image developing toner of the present invention generally falls within a range from 1% by mass to 30% by mass, preferably from 2% by mass to 20% by mass, and more preferably from 3% by mass to 15% by mass.

A low-molecular-weight polypropylene (number-average molecular weight=1500 to 9,000) and a low-molecular-weight polyethylene can typically be used as the mold releasing agent. Preferable mold releasing agents are ester-base compounds expressed by the general formula (3). General formula (3):

$$R_1—(OCO—R_2)_n$$

in the general formula (3), n is an integer of 1 to 4, preferably 2 to 4, more preferably 3 to 4, and most preferably 4.

$R_1$ and $R_2$ represent a hydrocarbon group which may have a substituent:

$R_1$: $C_{1-40}$, more preferably $C_{1-20}$; and $R_2$: $C_{1-40}$, more preferably $C_{16-30}$, and still more preferably $C_{18-26}$.

Specific examples of the ester compounds expressed by the above general formula (3) will be shown below, where the present invention is by no means limited thereto.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6)

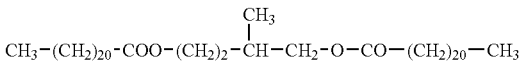

7)

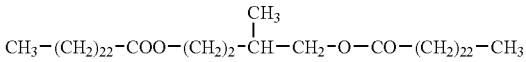

8)

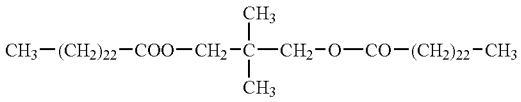

9)

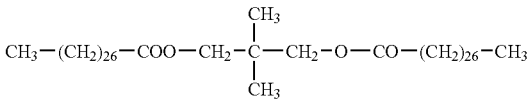

10)

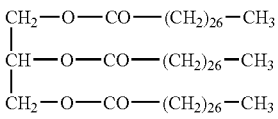

11)

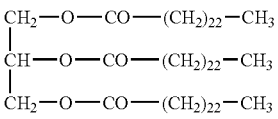

12)

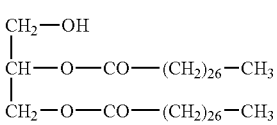

13)

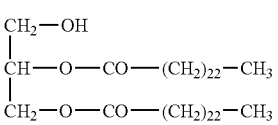

-continued

14)

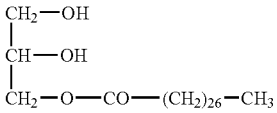

15)

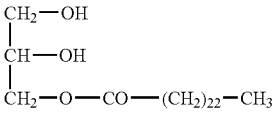

16)

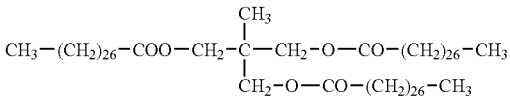

17)

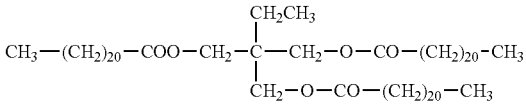

18)

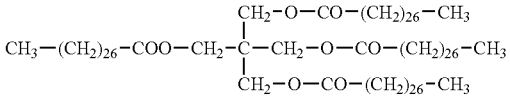

19)

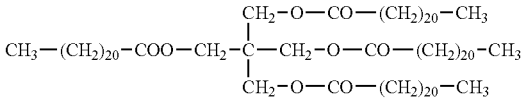

20)

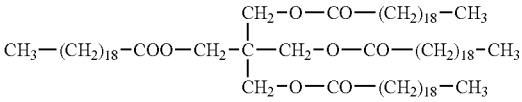

21)

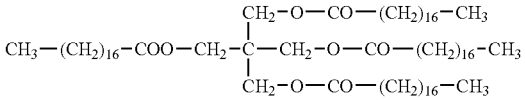

Amount of addition of the above-described mold releasing agent and the fixation modifier expressed by the general formula (3) is adjusted to 1% by mass to 30% by mass of the total mass of the electrostatic charge image developing toner, more preferably 2% by mass to 20% by mass, and still more preferably 3% by mass to 15% by mass.

Preferable molecular weight, range of the molecular weight, peak molecular weight and so forth of the resin component composing the electrostatic charge image developing toner of the present invention will be explained in the next.

The toner of the present invention preferably has a peak or shoulder within a range from 1,000 to 50,000.

Molecular weight can be measured by GPC (gel permeation chromatography) using THF (tetrahydrofuran) as a column solvent.

More specifically, 1 mg of the sample to be measured is added with 1 ml of THF, and the mixture is stirred using a magnetic stirrer under room temperature so as to thoroughly dissolve it. The obtained solution is then filtered through a membrane filter having a pore size of 0.45 to 0.50 μm, and is then injected into a GPC. In the GPC measurement, the column is stabilized at 40° C., THF is flown at a flow rate of 1 ml/min, and approximately 100 μl of the sample having a concentration of 1 mg/ml is injected. The column used herein is preferably any combination of commercial polystyrene gel columns, which is exemplified by any combinations of Shodex GPC KF-801, 802, 803, 804, 805, 806 and 807 manufactured by Showa Denko K. K., or any combinations of TSKge1G1000H, G2000H, G3000H, G4000H, G5000H, G6000H, G7000H and TSK guard column manufactured by Tosoh Corporation.

A detector preferably used herein is exemplified by a refractive index detector (IR detector) or UV detector. In the molecular weight measurement of the sample, the molecular weight distribution of the sample is calculated using an analytical curve prepared using a monodisperse standard polystyrene particle. It is preferable to use approximately 10 samples of the polystyrene particle for the purpose of preparing the analytical curve.

<<Filtration-and-Washing Process>>

Next paragraphs will describe the filtration-and-washing process in the method of manufacturing the electrostatic charge image developing toner of the present invention.

The filtration-and-washing process includes a filtration process for filtering the toner particle off from a dispersion system of the toner particle obtained in the above-described process, and a washing process for washing any adhered matter such as the surfactant and dispersant away from the toner particle collected on the filter (cake-like aggregate).

The filtering process herein is not specifically limited, where centrifugal method, vacuum filtration method using Nutsche or the like, and filtration method using a filter press or the like are available. In the aforementioned filtration-and-washing process, most portion of the surfactant having two or more anionic groups in one molecule used in the present invention flows out from the toner particle by the washing, but it is possible to allow the surfactant to remain in the toner in an amount of 10 ppm to 10,000 ppm by the washing using ion-exchanged water in a volume of 20 to 80 times, and more preferably 30 to 60 times, larger than that of the solid content.

<<Drying Process>>

This is a process for drying the washed toner particle.

Dryers available in the process are exemplified by a spray dryer, a lyophilizer, and a reduced-pressure dryer, where more specific examples of preferable dryers include a stationary shelf dryer, a moving shelf dryer, a fluidized bed dryer, a rotary dryer, a stirring dryer and so forth.

Moisture content of the dried toner particle is preferably 5% by mass, and more preferably 2% by mass.

Any dried toner particles forming an aggregate through a weak inter-particle attractive force may be cracked. Available examples of cracking machine include mechanical ones such as jet mill, Henschel mixer, coffee mill and food processor.

Next paragraphs will describe the polymerizable monomer available in the present invention.

(1) Hydrophobic Monomer

The hydrophobic monomer composing the monomer component is not specifically limited, and any publicly-known monomer may be available. It is also allowable to use the hydrophobic monomer in a singular manner, or two or more species in combination so as to fulfill the requirements.

More specifically, available examples include monovinyl-aromatic-base monomer, (meth)acrylic-ester-base monomer, vinyl-ester-base monomer, vinyl-ether-base monomer, monoolefinic monomer, diolefinic monomer, halogenated-olefinic monomer or the like.

Examples of vinyl-aromatic-base monomer include styrene-base monomer and its derivatives, such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene.

Examples of the acrylic monomer include acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, diethylaminoethyl methacrylate or the like.

Examples of the vinyl ester monomer include vinyl acetate, vinyl propionate, vinyl benzoate or the like.

Examples of the vinyl-ether-base monomer include vinyl methyl ether, vinyl ethyl ether, vinyl isobutyl ether, vinyl phenyl ether or the like.

Examples of the monoolefinic monomer include ethylene, propylene, isobutylene, 1-butene, 1-pentene, 4-methyl-1-pentene or the like.

Examples of the diolefinic monomer include butadiene, isoprene, chloroprene or the like.

(2) Crosslinkable Monomer

It is also allowable to add a crosslinkable monomer in order to improve characteristics of the resin particle. Examples of the crosslinkable monomer include those having two or more unsaturated bonds, such as divinyl benzene, divinyl naphthalene, divinyl ether, diethylene glycol methacrylate, ethylene glycol dimethacrylate, polyethylene glycol dimethacrylate, diallyl phthalate or the like.

(3) Monomer Having Acidic Polar Group

Monomer having acidic polar group can be exemplified by (a) α,β-ethylenic unsaturated compound having a carboxyl group (—COOH), and (b) α,β-ethylenic unsaturated compound having a sulfonic group (—$SO_3H$).

Examples of (a) α,β-ethylenic unsaturated compound having a carboxyl group (—COOH) include acrylic acid, methacrylic acid, fumaric acid, maleic acid, itaconic acid, cinnamic acid, monobutyl maleate, monooctyl maleate, and salts of metals such as Na, Zn or the like of these compound.

Examples of (b) α,β-ethylenic unsaturated compound having sulfo group (—$SO_3H$) include sulfonated styrene, Na salt thereof, allylsulfosuccinic acid, octyl allylsulfosuccinate, and Na salt thereof.

Next paragraphs will describe the initiator (also referred to as polymerization initiator) available for polymerizing the polymerizable monomer in the present invention.

The polymerization initiator available in the present invention can properly be selected from those soluble in water, and examples of which include persulfate (e.g., potassium persulfate, ammonium persulfate or the like); azo compounds (e.g., 4,4'-azobis-4-cyanovaleric acid and salt thereof, 2,2'-azobis(2-amidinopropane) salt or the like); hydrogen peroxide; and peroxide compounds such as benzoyl peroxide or the like.

The polymerization initiator may be combined with a reducing agent so as to be used as a redox initiator if necessary. Use of the redox initiator expectedly enhances the polymerization activity, consequently lowers the polymerization temperature, and further shortens the polymerization time.

The polymerization temperature is selectable at any temperatures not lower than the lowest radical generation temperature of the polymerization initiator, where a temperature range of 50° C. to 80° C. is typically adopted. It is, however, also possible to proceed the polymerization at room temperature or around when any polymerization initiator capable of acting at ordinary temperatures, such as hydrogen peroxide as combined with a reducing agent (ascorbic acid, etc.), is used.

(Chain Transfer Agent)

Next paragraphs will describe the chain transfer agent available in the present invention.

In the present invention, it is allowable to use publicly-known and generally-used chain transfer agents for the purpose of adjusting the molecular weight of the resin particle produced by polymerization of the polymerizable monomers.

The chain transfer agent is not specifically limited, but in particular compounds having mercapto group are preferably used because of their potential of yielding toners having a sharp molecular weight distribution, desirable storability, fixation strength and resistance against offset printing. Examples of the agent include mercapto-group-containing thiol compounds such as pentane thiol, hexane thiol, heptane thiol, octane thiol, nonane thiol, decane thiol, dodecane thiol, and tert-dodecane thiol.

<<Colorant>>

The following paragraphs will describe the colorants available in the present invention.

The colorants used for the electrostatic charge image developing toner of the present invention is preferably contained within the toner particle as being salted, coagulated and fused when the above-described composite resin particle is salted, coagulated and fused during the manufacture of the toner, in view of improving uniformity in electrostatic charging of the toner.

The colorant composing the toner of the present invention (colorant particle subjected to salting-out, coagulation and fusion with the composite resin particle) can be exemplified by various types of inorganic pigment, organic pigment and dye. The inorganic pigment may be any of publicly-known ones. Specific examples of the inorganic pigment are listed below.

Black pigment may typically be carbon black such as furnace black, channel black, acetylene black, thermal black, lamp black or the like; and further may be magnetic powder such as magnetite, ferrite or the like.

It is also allowable to use the inorganic pigment in a singular manner, or two or more species in combination so as to fulfill the requirements. Amount of addition of the inorganic pigment is selected as 2 to 20%, more preferably 3 to 15% by mass, with respect to the polymer.

The above-described magnetite can be added when the toner is used as a magnetic one. In this case, magnetite is preferably added to the toner in an amount of 20 to 120% by mass in view of giving a predetermined magnetic characteristic.

Also the organic pigments and dyes may be any of those publicly known. Specific examples of the organic pigments and dyes are listed below.

Examples of the pigment for magenta or red toner include C.I.Pigment Red 2, C.I.Pigment Red 3, C.I.Pigment Red 5, C.I.Pigment Red 6, C.I.Pigment Red 7, C.I.Pigment Red 15, C.I.Pigment Red 16, C.I.Pigment Red 48:1, C.I.Pigment Red 53:1, C.I.Pigment Red 57:1, C.I.Pigment Red 122, C.I.Pigment Red 123, C.I.Pigment Red 139, C.I.Pigment Red 144, C.I.Pigment Red 149, C.I.Pigment Red 166, C.I.Pigment Red 177, C.I.Pigment Red 178, C.I.Pigment Red 222 or the like.

Examples of the pigment for orange or yellow toner include C.I.Pigment Orange 31, C.I.Pigment Orange 43, C.I.Pigment Yellow 12, C.I.Pigment Yellow 13, C.I.Pigment Yellow 14, C.I.Pigment Yellow 15, C.I.Pigment Yellow 17, C.I.Pigment Yellow 93, C.I.Pigment Yellow 94, C.I.Pigment Yellow 138, C.I.Pigment Yellow 180, C.I.Pigment Yellow 185, C.I.Pigment Yellow 155, C.I.Pigment Yellow 156 or the like.

Examples of the pigment for green or cyan toner include C.I.Pigment Blue 15, C.I.Pigment Blue 15:2, C.I.Pigment Blue 15:3, C.I.Pigment Blue 16, C.I.Pigment Blue 60, C.I.Pigment Green 7 or the like.

Available examples of the dyes include C.I.Solvent Red 1, ditto 49, ditto 52, ditto 58, ditto 63, ditto 111, ditto 122, C.I.Solvent Yellow 19, ditto 44, ditto 77, ditto 79, ditto 81, ditto 82, ditto 93, ditto 98, ditto 103, ditto 104, ditto 112, ditto 162, C.I.Solvent Blue 25, ditto 36, ditto 60, ditto 70, ditto 93, ditto 95, and any mixtures of these dyes.

These organic pigments and dyes may be used in a singular manner or in combination of two or more species if necessary. Amount of addition of the organic pigment is selected as 2 to 20%, more preferably 3 to 15% by mass, with respect to the polymer.

The toner particle composing the toner of the present invention may contain an internal additive other than mold releasing agent, which is typified by charge control agent.

The charge control agent contained in the toner particle can be exemplified by nigrosine-base dye, metal salt of naphthenic acid or higher fatty acid, alkoxylated amine, quaternary ammonium salt compound, azo-base metal complex, and salicylic acid metal salt or its metal complex.

Next paragraphs will describe the external additive available for the toner of the present invention.

Inorganic fine particle available as the external additive may be exemplified by those publicly known. More specifically, fine silica particle, fine titanium particle and fine alumina particle, for example, can preferably be used. These inorganic fine particles are preferably hydrophobic.

Specific examples of the fine silica particle include R-805, R-976, R-974, R-972, R-812 and R-809 commercially available from Nippon Aerosil Co., Ltd.; HVK-2150 and H-200 from Hoechst AG; TS-720, TS-530, TS-610, H-5 and MS-5 md from Cabot Corporation, or the like.

Specific examples of the fine titanium particle include T-805 and T-604 commercially available from Nippon Aerosil Co., Ltd.; MT-100S, MT-100B, MT-500BS, MT-600, MT-600SS and JA-1 from TAYCA Corporation; TA-300SI, TA-500, TAF-130, TAF-510 and TAF-510T from Fuji Titanium Industry Co., Ltd.; IT-S, IT-OA, IT-OB and IT-OC from Idemitsu Kosan Co., Ltd, or the like.

Specific examples of the fine alumina particle include RFY-C and C-604 commercially available from Nippon Aerosil Co., Ltd.; TTO-55 from Ishihara Sangyo Kaisha, Ltd, or the like.

The organic fine particle available as the external additive may be exemplified by those having a number-average primary particle size of approximately 10 to 2,000 nm and a spherical geometry. Material for composing the organic fine particle can be exemplified by polystyrene, polymethyl methacrylate, styrene-methyl methacrylate copolymer and so forth.

Lubricant available as the external additive can be exemplified by metal salt of higher fatty acid. Specific examples of the metal salt of higher fatty acid include metal salt of stearic acid such as zinc stearate, aluminum stearate, copper stearate, magnesium stearate, calcium stearate or the like; metal salt of oleic acid such as zinc oleate, manganese oleate, iron oleate, copper oleate, magnesium oleate or the like; metal salt of palmitic acid such as zinc palmitate, copper palmitate, magnesium palmitate, calcium palmitate or the like; metal salt of linolic acid such as zinc linoleate, calcium linoleate or the like; and metal salt of recinolic acid such as zinc recinoleate, calcium recinoleate or the like.

Amount of addition of the external additive is preferably 0.1 to 1% by mass or around with respect to the toner.

<<Process of Adding the External Additive>>

Process of adding the external additive will be described in the next.

This process is the one for adding the external additive to the dried toner particle. Instrument used for adding the external additive can be exemplified by various publicly-known mixers such as tabular mixer, Henschel mixer, Nauter mixer, V-shape blender or the like.

Particle size of the electrostatic charge image developing toner of the present invention will be described in the next.

The particle size of the toner of the present invention is preferably 3 μm to 10 μm, and more preferably 3 μm to 8 μm, on the basis of number-average particle diameter. The particle size can be controlled in the method of manufacturing the toner described later, by adjusting concentration of the coagulant, amount of addition of the organic solvent, fusing time and composition of the polymer.

A number-average particle diameter adjusted to 3 μm to 10 μm is successful in reducing fine toner particle having a strong adhesiveness which flies and lands on the heating member to thereby produce offset, and in raising transfer efficiency, which results in improved quality of image quality of halftone area, thin line and dots.

The number-average particle diameter of the toner can be measured by typically using Coulter counter TA-II, Coulter Multisizer, laser diffraction particle size analyzer SALD1100 (product of Shimadzu Corporation) or the like.

In the present invention, Coulter Multisizer connected with a personal computer through an interface (product of Nikkaki Co., Ltd.) for outputting the particle diameter distribution was used. An aperture of 100 μm was used in the Coulter Multisizer, and the particle size distribution and mean particle diameter were calculated by measuring number distribution of the toner particle having a diameter of 2 μm or larger.

(Shape Factor of Toner Particle)

The shape factor of the toner particle of the present invention will be described in the next.

The shape factor of the toner particle of the present invention is expressed by the formula below, which represents the degree of roundness of the toner particle.

$$\text{Shape factor}=((\text{maximum diameter}/2)^2\times\pi)/\text{projected area}$$

Maximum diameter herein refers to a width of the toner particle which gives a maximum distance between two parallel lines drawn so as to place a projected image of the toner particle fallen on a plane in between. The projected area herein means an area of the projected image of the toner particle fallen on a plane.

In the present invention, the shape factor was measured by taking a photograph of the toner particles at a 2,000× magnification under a scanning electron microscope, and then analyzing the obtained photograph using a scanning image analyzer (product of JEOL). In the present invention, 100 toner particles were used for the calculation of the shape factor based on the above-described equation.

In the toner particle composing the electrostatic charge image developing toner of the present invention, a portion of the toner particle having a shape factor of 1.0 to 1.6 preferably accounts for 65% by number or above, and more preferably for 70% by number or above. Further more preferably, a portion of the toner particle having a shape factor of 1.2 to 1.6 accounts for 65% by number or above, and more preferably for 70% by number or above.

Adjustment of the content of the toner particle having a shape factor of 1.0 to 1.6 to 65% by number or above is successful in making friction charging property typically using the developing agent carrying member more uniform, avoiding accumulation of excessively-charged toner, enhancing exchange of the toner from the surface of the developing agent carrying member, and consequently making it less likely to cause ghost in the development. This also provides subsidiary effects of making the toner particle less crushable, reducing contamination of the electrostatic charging member, and stabilizing the electrostatic charging of the toner.

There is no special limitation on method of controlling the shape factor. In one possible method, the toner particle of which shape factor is adjusted 1.0 to 1.6, or 1.2 to 1.6, is prepared by a method of spraying the toner particle into hot air flow, a method of repetitively applying mechanical energy based on impact force to the toner particle in a gas phase, or a method of applying a swirling flow to the toner particle added in a solvent not dissolving the toner particle, and the obtained toner particle is added to an ordinary toner so as to satisfy the range of content specified in the present invention. Another possible method is such as preparing the toner particle so as to have a shape factor of 1.0 to 1.6, or 1.2 to 1.6, by controlling the whole shape thereof already in the stage of preparing the so-called polymerized toner, and then similarly adding the resultant toner to the ordinary toner.

(Coefficient of Variation for Shape Factor of Toner Particle)

A coefficient of variation for shape factor of the toner particle of the present invention can be calculated using the equation below:

$$\text{Coefficient of variation (\%)}=(S_1/K)\times 100$$

where, $S_1$ is a standard deviation of shape factor obtained from 100 toner particles, and K is a mean value of the shape factor.

As for the toner particle composing the toner of the present invention, a coefficient of variation of the shape factor is preferably 16% or less, and more preferably 14% or less. Adjustment of the coefficient of variation of shape factor to 16% or less is successful in further sharpening the distribution of amount of charging, and thereby improving image quality.

In order to control the shape factor and the coefficient of variation thereof in an extremely uniform manner without causing inter-lot variation, it is also allowable to determine an appropriate timing of process termination while monitoring the toner particle (coloring particle) under formation in the process of preparation (polymerizing), fusion or shape control of the resin particle (polymer particle) composing the toner of the present invention. The monitoring herein means control of process conditions based on results of the measurement obtained from a measuring instrument incorporated in-line. More specifically, in the formation of a polymerized toner which is formed by allowing the resin particle to associate or fuse in a water-base medium, shape measurement, for example, is incorporated in-line, the shape and particle size are measured by sequential sampling typically during the fusing process, and the reaction is terminated when a desired shape is obtained. The monitoring can be carried out using a flow-type particle image analyzer FPIA-2000 (product of Toa Medical Electronics Co., Ltd.), although being not specifically limited.

This analyzer is convenient since it ensures a real-time image processing for shape monitoring while allowing the sample to flow therethrough. In other words, the analyzer is such as enabling continuous monitoring of the sample pumped up from the reaction field using a pump or the like, and terminating the reaction when a desired shape is achieved.

(Coefficient of Variation of Number of Toner)

Number particle size distribution and coefficient of variation thereof of the toner of the present invention can be measured using either of Coulter counter TA-II or Coulter Multisizer (products of Beckman Coulter, Inc.).

In the present invention, Coulter Multisizer connected with a personal computer through an interface (product of Nikkaki Co., Ltd.) for outputting the particle diameter distribution was used. An aperture of 100 μm was used in the Coulter Multisizer, and the particle size distribution and mean particle diameter were calculated by measuring volume and count of the toner particle having a diameter of 2 μm or larger. The number particle size distribution herein refers to a relative frequency of the toner particle with respect to the particle diameter, and the number-average particle diameter is a median diameter in the number particle size distribution. The "number coefficient of variation in the number particle size distribution" of the toner can be calculated by the equation below:

$$\text{Number coefficient of variation (\%)}=(S_2/D_n)\times 100$$

where, $S_2$ represents a standard deviation in the number particle size distribution, and $D_n$ represents a number average particle diameter (μm).

The number coefficient of variation of the toner particle composing the electrostatic charge image developing toner of the present invention is essentially 27% or less, and preferably 25% or less.

The reason why the number coefficient of variation is adjusted to 27% or less is same as that for the above-described coefficient of variation of the shape factor of the toner particle, aiming at sharpening distribution of the amount of charging and raising the transfer efficiency to thereby improve the image quality, synergistically with the effect of using the compounds (surfactant) expressed by the general formulae (1) or (2).

There is no specific limitation on the method of controlling the number coefficient of variation of the toner of the present invention. One possible method is such as classifying the toner particle by wind force, but classification in liquid is more effective in view of further reducing the number coefficient of variation. The method of classification in liquid can be realized by controlling the number of rotation of a centrifugal machine, by which the toner particle is recovered as being classified by difference in the sedimentation speed ascribable to diameter of the toner particle.

In particular for the case where the toner is manufactured by the emulsion polymerization process, the classification is essential in order to adjust the number coefficient of variation to 27% or less in the number particle size distribution. In the emulsion polymerization process, the polymerizable monomer is necessarily dispersed in a water-base medium in a form of oil droplet having a particle size desired for the toner. In practice, a large droplet of the polymerizable monomer is repetitively subjected to mechanical shearing typically using a homomixer or homogenizer, to thereby reduce the size of the oil droplet to as small as the toner particle. The method depending on the mechanical shearing can, however, produce only a broad number particle size distribution of the resultant oil droplet, so that polymerization of this monomer will result in the toner particle again having a broad particle size distribution. Classification is thus essential.

(Particle Size of Toner Particle)

When the toner particle composing the toner of the present invention is expressed by a histogram showing number-based particle size distribution, and having the abscissa, on which natural logarithm 1 nD, where D (μm) is particle diameter of the toner particle, is plotted, is divided by intervals of 0.23 into a plurality of classes, the toner preferably has a value of 70% or more for the sum (M) of relative frequency (m1) of the toner particle in the most populated class and relative frequency (m2) of the second most populated class.

Adjustment of the sum (M) of relative frequencies (m1) and (m2) to 70% or more means a narrowed particle size distribution of the toner particle, and use of such toner for the image forming process is successful in surely preventing the selective development from occurring.

In the present invention, the above-described histogram is such as showing the number-based particle size distribution based on division of natural logarithm 1 nD (D=particle diameter of the individual toner particles) by intervals of 0.23 into a plurality of classes (0 to 0.23; 0.23 to 0.46; 0.46 to 0.69; 0.69 to 0.92; 0.92 to 1.15; 1.15 to 1.38; 1.38 to 1.61; 1.61 to 1.84; 1.84 to 2.07; 2.07 to 2.30; 2.30 to 2.53; 2.53 to 2.76 . . . ). The histogram was prepared by measuring the sample using Coulter Multisizer, transferring the obtained particle diameter data through an I/O unit to a computer, and analyzing the data using a particle size distribution analyzing program run on the computer.

<<Measurement Conditions>>

(1) Aperture: 100 μm (2) Sample preparation method: A proper amount of a surfactant (neutral surfactant) is added to 50 to 100 ml of an electrolytic solution ([ISOTON R-11 (product of Coulter Scientific Japan)] and stirred, and 10 to 20 mg of the sample to be measured is added thereto. The obtained system was subjected to ultrasonic dispersion for one minute to thereby prepare the sample.

<<Rounded Toner Particle>>

Rounded toner particle having no angle is preferably used in the present invention.

Figure 1B:
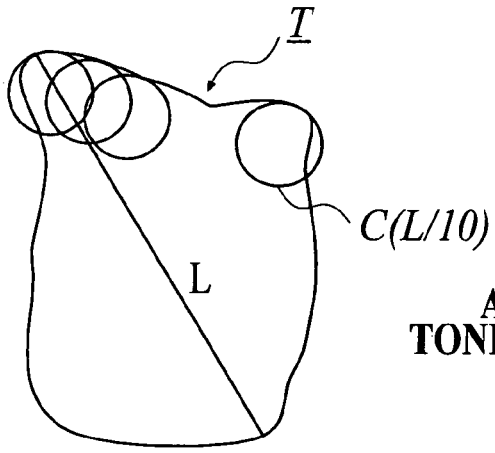
FIGS. 1B and 1C are explanatory views of projected images of angular toner particles.
Figure 1C:
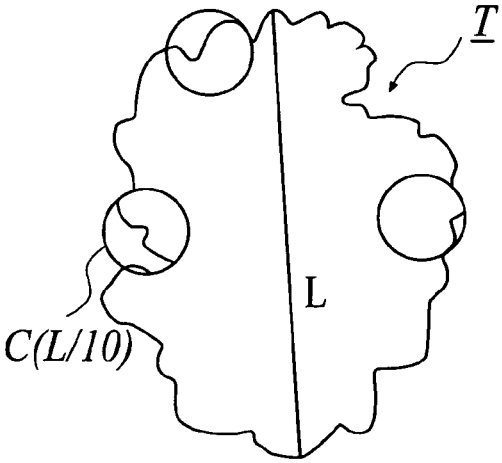

First, the "rounded toner" will be explained referring to FIGS. 1A to 1C.

In the toner of the present invention, the rounded toner preferably accounts for 50% by number or more, and more preferably 70% by number, of the total toner particle composing the toner.

Adjustment of the content of the rounded particle to as much as 50% by number is successful in reducing void in the transferred toner layer (powder layer), consequently improving the fixation property, and making it less likely to cause offset. This means that the toner which is likely to wear and break, and has a portion of concentrated electric charge is reduced in number. Thus, distribution of the amount of charging becomes more shaper, and electrostatic charging property becomes more stable. Accordingly, a desirable image quality can be obtained for the long period of time.

The "rounded toner particle" herein refers to a toner particle substantially having no projected portions likely to concentrate electric charge or likely to cause wear under stress, and is more specifically to a toner particle defined as below. That is, as shown in FIG. 1A, assuming now that the longer diameter of a toner particle T as L, the toner particle is judged as a "rounded toner particle" when a circle C having a radius of L/10 is rolled along the contour line of the toner particle T inside thereof while keeping a point contact with the toner particle T at one point inside the circle, and also when the circle C substantially does not go beyond the contour of the toner particle T. A phrase "substantially does not go beyond" herein allows a case having only one projection where the circle can goes beyond. The "length of toner particle" refers to a width of the particle which gives a maximum distance between two parallel lines drawn so as to place a projected image, formed on a plane, of the toner particle in between. FIGS. 1B and 1C show projected images of different angular toner particles.

Ratio of the rounded toner particle was measured as follows. First, a photograph of enlarged view of the toner particle is taken under a scanning electron microscope, and the view is further enlarged to obtain a photographic image at a 15,000× magnification. On this photographic image, presence or absence of the foregoing angle is measured. The measurement was carried out for 1,000 toner particles.

Method of obtaining the rounded toner particle is not specifically limited. For example, similarly to as described in the above in relation to the method of controlling the shape factor, available methods include a method of spraying the toner particle into hot air flow, a method of repetitively applying mechanical energy based on impact force to the toner particle in a gas phase, and a method of applying a swirling flow to the toner particle added in a solvent not dissolving the toner particle.

The developing agent used for the present invention will be explained in the next.

The toner of the present invention can be used in either form of single-component developing agent or dual-component developing agent.

The single-component developing agent can be configured as a non-magnetic, single-component developing agent, or as a magnetic single-component developing agent prepared by adding magnetic particle of 0.1 μm to 0.5 μm diameter to the toner, where both of which being available.

The toner can also be used as a dual-component developing agent mixed with a carrier. Magnetic particle used as the carrier in this case may be any publicly-known materials, and examples of which include metals such as iron, ferrite and magnetite; and alloys of these metals with other metals such as aluminum and lead. Ferrite is particularly preferably. The magnetic particle preferably has a volume-average particle diameter of 15 μm to 100 μm, and more preferably 25 μm to 80 μm.

The volume-average particle size of the carrier can be measured typically using a laser diffraction particle size distribution analyzer "HELOS" (manufacture by Sympatec GmBH) equipped with a wet disperser.

The carrier preferably has the magnetic particle further coated by a resin, or has the magnetic particle dispersed in a resin so as to form so-called resin-dispersed carrier. Examples of the resin suitable for the coating include olefin-base resin, styrene-base resin, styrene-acryl-base resin, silicone-base resin, ester-base resin and fluorine-containing-polymer-base resin, although being not specifically limited. The resin for composing the resin-dispersed carrier may also be selected from any publicly-known ones without special limitation, and examples of which include styrene-acryl-base resin, polyester resin, fluorine-containing resin, phenol resin or the like.

<<Image Formation Method>>

Image formation method adopted to the present invention will be described in the next.

Figure 2:
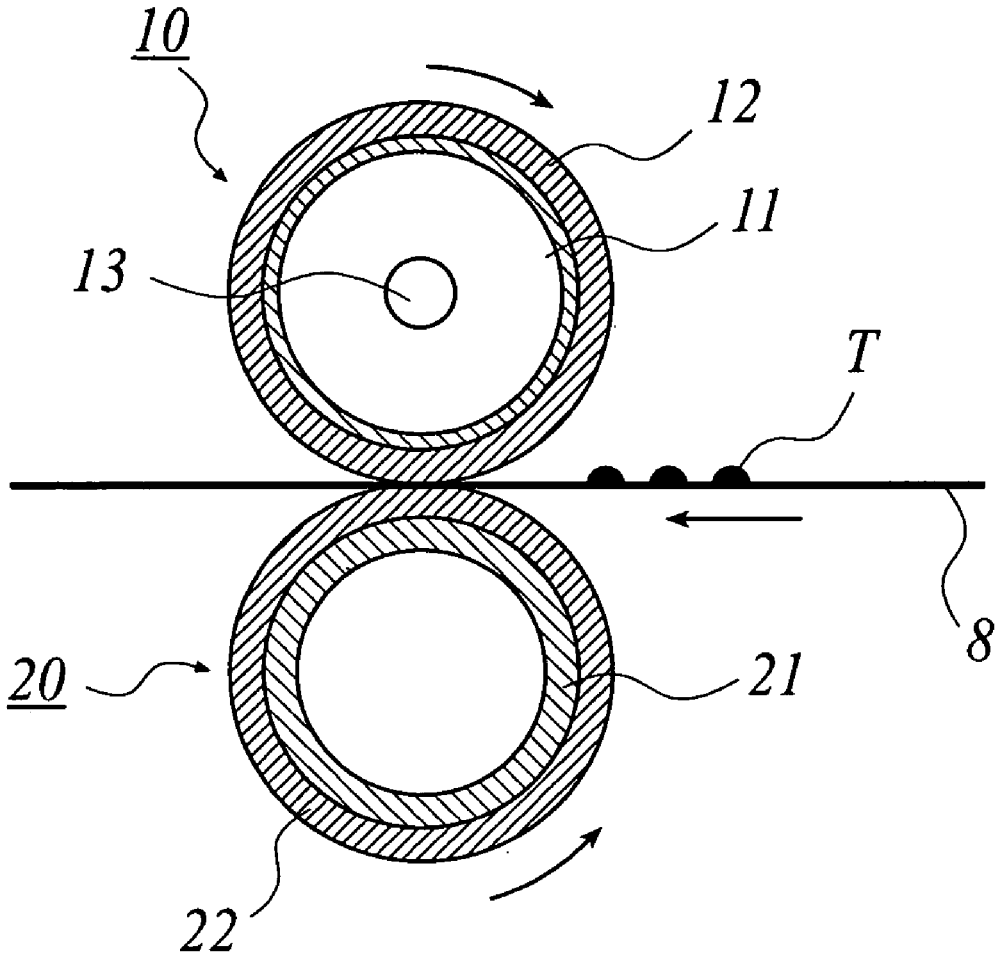
FIG. 2 is a sectional view showing an exemplary fixation device used in the present invention.

The toner of the present invention is preferably used in an image forming method (image forming method of the present invention) which includes a step of fixing a toner image formed on an image forming support by allowing it to pass through between a heating roller and pressure roller composing a fixation device. FIG. 2 is a sectional view of an exemplary fixation device used for the image forming method of the present invention. The fixation device shown in FIG. 2 comprises a heating roller 10 and a pressure roller 20 kept in contact therewith. In FIG. 2, T denotes a toner image formed on a transfer paper (image forming support).

The heating roller 10 is configured such that a coating layer 12 composed of a fluorine-containing resin or an elastic material is formed on a surface of a core bar 11, and a heating member 13 comprising a line heater is enclosed inside thereof.

The core bar 11 is made of a metal, and has an inner diameter of 10 mm to 70 mm. Metal composing the core bar 11 is not specifically limited, and examples of which include metals such as iron, aluminum, copper or the like, or alloys of these metals.

Thickness of the core bar 11 is 0.1 mm to 15 mm, which is determined so as to find the best balance between requirements for the energy saving (thinning) and strength (depending on compositional material). For example, an aluminum-made core bar can attain a strength of an iron-made core bar of 0.57 mm thick iron when it has a thickness of as large as 0.8 mm.

The fluorine-containing resin composing the coating layer 12 can be exemplified by PTFE (polytetrafluoroethylene) and PFA (tetrafluoroethylene-perfluoroalkyl vinyl ether copolymer).

Thickness of the coating layer 12 comprising the fluorine-containing resin is adjusted to 10 μm to 500 μm, and more preferably to 20 μm to 400 μm.

Thickness of the coating layer 12 composed of the fluorine-containing resin of less than 10 μm may fail in fully exhibiting function of the coating layer, and consequently fail in ensuring durability of the fixation device. On the other hand, the coating layer having a thickness exceeding 500 μm is likely to get scratches due to paper dust on the surface thereof, and the scratches tends to catch the toner or the like and to cause dirt on the image.

As the elastic material for composing the coating layer 12, silicone rubber having a desirable heat resistance such as LTV, RTV and HTV; and silicone sponge rubber can preferably be used.

ASKER C hardness of the elastic material composing the coating layer 12 is adjusted to less than 80°, and preferably less than 60°.

Thickness of the coating layer composed of the elastic material is adjusted to 0.1 mm to 30 mm, and more preferably to 0.1 mm to 20 mm.

ASKER C hardness of the elastic material composing the coating layer 12 exceeding 80°, and a thickness of the coating layer 12 less than 0.1 mm will fail in increasing nip in the fixation, and also fail in exhibiting soft fixation effect (e.g., effect of improving color reproducibility by a toner layer on a smoothened interface).

A halogen heater is preferably used as the heating member 13.

The pressure roller 20 has a core bar 21 on the surface of which a coating layer 22 composed of an elastic material is formed. The elastic material for composing the coating layer 22 is not specifically limited, and can be exemplified by various soft rubbers such as urethane rubber and silicone rubber, and sponge rubber, and the aforementioned silicone rubber and silicone sponge rubber exemplified as those composing the coating layer 12 are again preferably used.

ASKER C hardness of the elastic material composing the coating layer 22 is adjusted to less than 80°, preferably less than 70°, and still more preferably less than 60°.

Thickness of the coating layer 22 is adjusted to 0.1 to 30 mm, and preferably to 0.1 to 20 mm.

ASKER C hardness of the elastic material composing the coating layer 22 exceeding 80°, and a thickness of the coating layer 22 less than 0.1 mm will fail in increasing nip in the fixation, and also fail in exhibiting soft fixation effect.

Metal composing the core bar 21 is not specifically limited, and examples of which include metals such as aluminum, iron, copper or the like, or alloys of these metals.

Contact load (total load) between the heating roller 10 and pressure roller 20 is generally adjusted to 40 N to 350 N, and more preferably to 50 N to 300 N, and still more preferably to 50 N to 250 N. The contact load is specified considering the strength (thickness of the core bar 11) of the heating roller 10, and in an exemplary case of a heating roller having an iron-made core bar of 0.3-mm thick, the contact load is preferably adjusted to 250 N or less.

From the viewpoint of anti-offset property and fixation property, nip width is preferably adjusted to 4 to 10 mm, and the surface pressure of the nip is preferably adjusted to $0.6\times10^5$ Pa to $1.5\times10^5$ Pa.

In exemplary conditions for fixation by the fixation device shown in FIG. 2, the fixation temperature (surface temperature of the heating roller 10) is adjusted to 150° C. to 210° C., and linear fixation velocity is adjusted to 80 mm/sec to 640 mm/sec.

The fixation device used in the present invention may be equipped with a cleaning mechanism if necessary. In this case, a system for supplying silicone oil to the upper roller (heating roller) of the fixation section may be such as using a pad, roller, web or the like immersed with the silicone oil, and then cleaning the oil.

Silicone oil is selected from those having an excellent heat resistance, and examples of which include poly(dimethyl silicone), poly(phenylmethyl silicone), poly(diphenyl silicone) or the like. Those having a low viscosity tends to increase the flow volume during the use, so that those having a viscosity at 20° C. of 1 Pa·s to 100 Pa·s can preferably be used.

It is to be noted, however, that the effect of the present invention will most eminently be exhibited when image is formed using a fixation device in no need of silicone oil supply, or requiring only a small amount of silicone oil supply. It is therefore preferable that, even for the case where silicone oil is used, the amount of supply thereof is preferably adjusted to as small as 2 mg/A4 or less.

Adjustment of the supply volume of silicone oil to as small as 2 mg/A4 or below can successfully reduce the amount of adhesion of the silicone oil to the transfer paper (image support) after the fixation, and can solve a problem of poor writability with an oil-base pen such as ball-point pen due to silicone oil adhered to the transfer paper, and can thus be exempt from being degraded in the writability.

It is also successful in avoiding problems of time-dependent degradation of the anti-offset property due to denaturation of the silicone oil, or contamination of an optical system or a band electrode with the silicone oil.

Amount of supply of the silicone oil herein can be calculated by allowing 100 sheets of transfer paper (A4 white paper) through the fixation device (between the rollers) heated at a predetermined temperature, and by measuring difference in the mass (Δw) of the fixation device before and after the paper pass (Δw/100).

EXAMPLES

The following paragraphs will describe Examples of the present invention, by which the present invention will never be limited.

<<Manufacture of Electrostatic Charge Image Developing Toner 1>>

A resin particle dispersion 1HML and a colorant particle dispersion 1 were respectively prepared as described below, the resin particle dispersion 1HML and the colorant particle were then mixed so as to allow the resin particle and colorant particle to associate to thereby produce a coloring particle, and the coloring particle was further added with an external additive to thereby manufacture the electrostatic charge image developing toner 1.

<<Preparation of Resin Particle Dispersion 1HML>>

The resin particle dispersion 1HML was prepared by going through the steps (1) to (3) below.

(1) Preparation of Resin Particle Dispersion (1H):

Formation of Core Particle; First-Step Polymerization

In a 5,000-ml separable flask attached with a stirrer, a temperature sensor, a condenser and a nitrogen introducing device, an aqueous surfactant solution (water-base medium) prepared by dissolving 7.08 g of Compound 1 in 3,010 g of ion-exchanged water is placed, and the inner temperature was elevated to 80° C. under stirring at a speed of 230 rpm in a nitrogen gas flow.

To the surfactant solution, an initiator solution prepared by dissolving 9.2 g of a polymerization initiator (potassium persulfate: KPS) in 200 g of ion-exchanged water was added, the temperature was adjusted to 75° C., and a monomer mixture solution comprising 70.1 g of styrene, 19.9 g of n-butyl acrylate and 10.9 g of methacrylic acid was dropwisely added over one hour, the mixture was kept at 75° C. for 2 hours under stirring so as to proceed polymerization (first-step polymerization), to thereby prepare a resin particle dispersion (a dispersion liquid of the resin particle composed of a high-molecular-weight resin). This is referred to as "resin particle dispersion (1H)".

(2) Preparation of Resin Particle Dispersion (1 HM)

(Formation of Intermediate Layer: Second-Step Polymerization)

In a flask attached with a stirrer, a monomer mixture solution containing 105.6 g of styrene, 30.0 g of n-butyl acrylate, 6.4 g of methacrylic acid, 5.6 g of n-octyl-3-mercapto propionate is added with 72.0 g of Exemplary Compound 19), and the mixture was heated to 80° C. for solubilization, to thereby prepare a monomer solution.

On the other hand, a surfactant solution prepared by dissolving 1.6 g of Compound 1 in 2,700 ml of ion-exchanged water was heated to 80° C., the surfactant solution was then added with 28 g on the solid content basis of the above-described resin particle dispersion (1H), and the monomer solution was mixed and dispersed using a mechanical dispersion machine "CLEARMIX" (product of M-TECHNIQUE), which is a mechanical dispersion machine having a circulatory path, to thereby prepare a dispersion (emulsion) containing an emulsified particle (oil droplet) which was found to have a dispersion particle diameter of 284 nm by a measurement using MICROTRAC UPA (MODEL:9340-UPA, product of Nikkiso Co., Ltd.).

Next, the dispersion (emulsion) is added with an initiator solution prepared by dissolving 5.1 g of a polymerization initiator (KPS: potassium persulfate) in 240 ml of ion-exchanged water, and with 750 ml of ion exchanged water, and the obtained system was heated at 80° C. for 3 hours under stirring so as to proceed polymerization (second-step polymerization), to thereby obtain a resin particle dispersion (a dispersion of a composite resin particle having a structure in which a resin particle composed of a high-molecular-weight resin is coated by a medium-molecular-weight resin). This is referred to as "resin particle dispersion (1HM)".

(3) Preparation of Resin Particle Dispersion (1HML)

(Formation of Outer Layer: Third-Step Polymerization)

To the resin particle dispersion (1HM) obtained in the above, an initiator solution prepared by dissolving a polymerization initiator (KPS: potassium persulfate) in 200 ml of ion-exchanged water was added, a monomer mixture solution comprising 300 g of styrene, 95 g of n-butyl acrylate, 15.3 g of methacrylic acid and 10.4 g of n-octanethiol was dropwisely added thereto over one hour under a temperature condition of 80° C., the mixture was kept under heating and stirring for 2 hours so as to proceed polymerization (third-step polymerization), the mixture was cooled to 28° C., to thereby obtain a resin particle dispersion (having a central portion composed of a high-molecular-weight resin, an intermediate layer composed of an intermediate-molecular-weight resin and an outer layer composed of a low-molecular-weight resin, and the intermediate layer contains Exemplary Compound 19). This is referred to as "resin particle dispersion (1HML)".

The composite resin particle composing the resin particle dispersion (1HML) was found to have peak molecular weights of 138,000, 80,000 and 13,000, and to have a number-average particle diameter of 116 nm.

<<Preparation of Colorant Dispersion 1>>

As a surfactant, 59.0 g of Compound 1 was dissolved in 1,600 ml of ion-exchanged water under stirring, to thereby prepare a surfactant solution. The solution was kept under stirring, 240.0 g of phthalocyanine dye (C.I.Pigment Blue 15:2) was gradually added thereto, and the mixture was then dispersed using "CLEARMIX" (product of M-TECHNIQUE), to thereby prepare a dispersion 1 of the colorant particle (referred to as "colorant dispersion 1", hereinafter).

Particle diameter of the colorant particle in the colorant dispersion 1 was found to be 48 nm in terms of weight-average particle diameter when measured using an electrophoretic light scattering photometer "ELS-800" (product of Otsuka Electronics Co., Ltd.).

<<Association Process>>

In a reaction container (four-necked flask) attached with a temperature sensor, a condenser, a nitrogen introducing device and a stirrer, 420.7 g (solid-base) of the resin particle dispersion 1HML, 900 g of ion-exchanged water and 166 g of the colorant dispersion 1 were placed and stirred. Next, a surfactant solution prepared by dissolving 2.0 g of Compound 1 in 300 ml of ion-exchanged water was added, the inner temperature was adjusted to 30° C., and a 5 mol/l aqueous sodium hydroxide solution was added thereto so as to adjust the pH to 10.

The mixture was then cooled to 40° C. at a cooling speed of 8° C./min, added with hydrochloric acid so as to adjust the pH to 2.6, and the stirring was terminated. The resultant associated particle was filtered off, repetitively washed using ion-exchanged water conditioned at 45° C., and then dried under warm air at 40° C. to thereby obtain a coloring particle 1 having a number-average particle diameter of 5.7 μm.

Thus-obtained coloring particle 1 was further added with 0.5 parts by mass of hydrophobic silica (N-octyl methoxysilane having a number-average primary particle diameter of 12 nm, 1.0 part by mass of hydrophobic titanium oxide having a number-average primary particle diameter of 28 nm, and 3.0 parts by mass of hydrophobic silica (hexamethyldisilazane) having a number-average primary particle diameter of 112 nm, and the mixture was mixed in Henschel mixer to thereby obtain an electrostatic charge image developing toner (also referred to as "toner 1", hereinafter) Residual amount of Compound 1 in the toner 1 was found to be 280 ppm.

<<Manufacture of Electrostatic Charge Image Developing Toners 2 to 8, and Comparative Toners 11 to 13>>

Electrostatic charge image developing toners 2 to 8 (present invention) and comparative electrostatic charge image developing toners 11 to 13 were manufactured similarly to as described for the electrostatic charge image developing toner 1, except that Compound 1 used in the individual processes (preparation of the resin particle dispersion (1HML), preparation of the colorant particle dispersion 1 and association process) was replaced with the compounds as listed in Table 1.

Comparative compound 1: $C_{12}H_{25}OSO_3Na$

Comparative compound 2: $C_{12}H_{25}(OCH_2OCH_2)OSO_3Na)$

Comparative compound 3

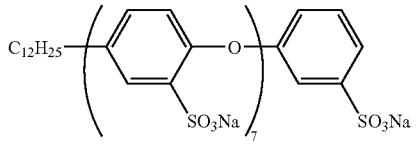

Comparative compound 4

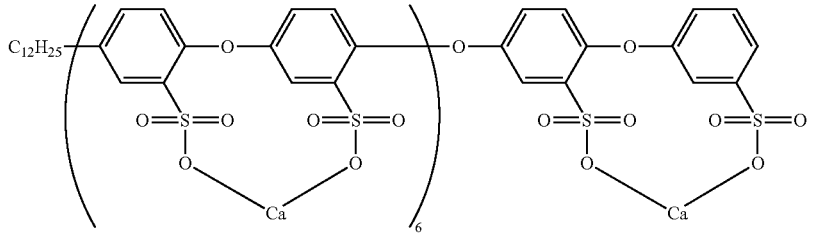

Next, an aqueous solution prepared by dissolving 12.1 g of magnesium chloride hexahydrate in 1,000 ml of ion-exchanged water was added under stirring at 30° C. over 10 minutes. The mixture was allowed to stand for 3 minutes, and the temperature of the system was elevated to 94° C. over 6 minutes. Particle diameter of the associated particle in this status was measured using "Coulter Multisizer", and upon confirming that the number-average particle diameter reached 5.5 μm, an aqueous solution prepared by dissolving 80.4 g of sodium chloride in 1,000 ml of ion-exchanged water was added in order to terminate the particle-growth, and the mixture was further kept under heating and stirring at 85° C. for 2 hours for ripening so as to proceed the fusion.

<<Manufacture of Electrostatic Charge Image Developing Toner 9>>: Present Invention Electrostatic charge image developing toner 9 of the present invention was manufactured by mixing the resin particle dispersion A, colorant particle dispersion 1 (same as that used for the manufacture of the electrostatic charge image developing toner 1), mold releasing agent dispersion A, charge control agent particle dispersion A, and compounds (surfactants) expressed by the general formula (1) or (2) according to the present invention, and by allowing the resin particle, colorant particle and charge control particle to associate.

<<Preparation of Mold Releasing Dispersion A>>

Mixed were 68.33 parts of ion-exchanged water, 30 parts of exemplary compound 19, and 1.67 parts of Compound 1, the mixture was emulsified under high-pressure shearing force, to thereby obtain a dispersion of the mold releasing agent particle. Mean particle diameter of the mold releasing agent was found to be 350 nm. This is referred to as "mold releasing dispersion A".

<<Preparation of Resin Particle Dispersion A>>

A reaction vessel (2-liter capacity, 120-mm inner diameter) equipped with a stirrer (3 recessed impellers), heating/cooling device, concentrating device, and feeding devices for the individual source materials and auxiliaries was charged with 6 parts of a 15% aqueous solution of Compound 1 and 372 parts of ion-exchanged water, the mixture was heated to 90° C. under nitrogen gas flow, and the mixture was further added with 1.6 parts of an 8% aqueous hydrogen peroxide solution and 1.6 parts of an 8% aqueous ascorbic acid solution. A mixture of the polymerizable monomers and aqueous surfactant solution described below was then added over 5 hours from the start of the polymerization, and an aqueous initiator solution was added over 6 hours after the start of the polymerization, and the mixture was allowed to stand for 30 minutes.

After completion of the polymerization reaction, the mixture was cooled to thereby obtain a milky white resin particle dispersion A. Tetrahydrofuran-insoluble component of the polymer was found to be 10% by mass, weight-average molecular weight of tetrahydrofuran-soluble component was found to be 57,000, mean particle diameter measured using MICROTRAC UPA (MODEL 9340-UPA, product of Nikkiso Co., Ltd.) was found to be 56 nm, and Tg was found to be 84° C.

(Polymerizable Monomers)

| | |
|---|---|
| (Polymerizable Monomers) | |
| Styrene | 88 parts |
| Butyl acrylate | 12 parts |
| Acrylic acid | 2 parts |
| Bromotrichloromethane | 0.5 parts |
| 2-Mercapto ethanol | 0.01 parts |
| Hexanediol diacrylate | 0.4 parts |
| (Preparation of Aqueous Surfactant Solution) | |
| 15% Aqueous solution of compound 1 | 3 parts |
| Ion-exchanged water | 23 parts |
| (Preparation of Aqueous Initiator Solution) | |
| 8% Aqueous hydrogen peroxide solution | 9 parts |
| 8% Aqueous ascorbic acid solution | 9 parts |

<<Preparation of Charge Control Agent Particle Dispersion A>>

Twenty parts of 4,4'-Methylenebis[2-[N-(4-chlorophenyl) amido]-3-hydroxy naphthalene], 15 parts of compound 1, 76 parts of ion-exchanged water were dispersed in a sand grinder mill, to thereby obtain a charge control agent particle dispersion A. The mean particle diameter was found to be 200 nm.

<<Association Process>>

Resin particle dispersion A 5 parts (solid-base)

Colorant dispersion 1 6.7 parts (solid-base)

Mold releasing agent dispersion A 7 parts (solid-base)

Charge control agent particle dispersion A 2 parts (solid-base)

15%-by-mass aqueous solution of compound 1

0.5 parts (solid-base)

Using the above-described components, a toner was manufactured by the procedures below. In a reaction container (1-liter capacity, buffled anchor impeller), the resin particle dispersion A and a 15 wt % aqueous solution of Compound 1 were placed, mixed homogeneously, further added with the colorant particle dispersion 1, and the mixture was homogeneously mixed. The obtained mixed dispersion was dropwisely added with an aqueous aluminum sulfate under stirring (0.53 parts as solid-base).

The mixture was then heated to 50° C. over 25 minutes under stirring, allowed to stand for one hour, further heated to 63° C. over 35 minutes, and again allowed to stand for 20 minutes. The mixture was further added with a charge control particle dispersion A, resin particle dispersion A, aqueous aluminum sulfate solution (0.07 parts on the solid basis) in this order, heated to 65° C. over 10 minutes, and allowed to stand for 30 minutes. After adding a 15% aqueous solution of Compound 1 (3 parts on the solid basis), the mixture was heated to 96° C. over 30 minutes, and allowed to stand for 5 hours. The mixture was then cooled, filtered, washed with water, dried and added with an external additive similarly to the case of toner 1, to thereby obtain a toner (toner 9).

<<Manufacture of Electrostatic Charge Image Developing Toner 10>>: Present Invention An electrostatic charge image developing toner 10 was obtained similarly to the manufacture of the electrostatic charge image developing toner 9, except that the charge control particle dispersion A was not used in the association process.

Information of the surfactants (compounds expressed by the general formula (1) or (2), and comparative compounds) used in the individual process steps of manufacturing the electrostatic charge image developing toners 1 to 10 (present invention) and comparative electrostatic charge image developing toners 11 to 13 were listed in Table 1, and parameters related to geometry of the toner particle composing the individual toners were listed in Table 2.

TABLE 1

| | SURFACTANT USED IN TONER PARTICLE PREPARATION PROCESS | | | | | |
|---|---|---|---|---|---|---|
| TONER | DISPERSION OF RESIN PARTICLE | DISPERSION OF COLORANT | ASSOCIATION PROCESS | DISPERSION OF MOLD RELEASING AGENT·X | DISPERSION OF CHARGE CONTROL AGENT | REMARKS |
| 1 | COMPOUND 1 | COMPOUND 1 | COMPOUND 1 | NO PROCESS | NO PROCESS | PRESENT INVENTION |
| 2 | COMPOUND 2 | COMPOUND 2 | COMPOUND 2 | NO PROCESS | NO PROCESS | PRESENT INVENTION |

TABLE 1-continued

| TONER | SURFACTANT USED IN TONER PARTICLE PREPARATION PROCESS: DISPERSION OF RESIN PARTICLE | DISPERSION OF COLORANT | ASSOCIATION PROCESS | DISPERSION OF MOLD RELEASING AGENT·※ | DISPERSION OF CHARGE CONTROL AGENT | REMARKS |
|---|---|---|---|---|---|---|
| 3 | COMPOUND 3 | COMPOUND 3 | COMPOUND 3 | NO PROCESS | NO PROCESS | PRESENT INVENTION |
| 4 | COMPOUND 4 | COMPOUND 4 | COMPOUND 4 | NO PROCESS | NO PROCESS | PRESENT INVENTION |
| 5 | COMPOUND 5 | COMPOUND 5 | COMPOUND 5 | NO PROCESS | NO PROCESS | PRESENT INVENTION |
| 6 | COMPOUND 6 | COMPOUND 6 | COMPOUND 6 | NO PROCESS | NO PROCESS | PRESENT INVENTION |
| 7 | COMPARATIVE COMPOUND 1 | COMPOUND 1 | COMPARATIVE COMPOUND 2 | NO PROCESS | NO PROCESS | PRESENT INVENTION |
| 8 | COMPARATIVE COMPOUND 1 | COMPOUND 2 | COMPARATIVE COMPOUND 2 | NO PROCESS | NO PROCESS | PRESENT INVENTION |
| 9 | COMPOUND 1 | COMPOUND 1 | COMPOUND 1 | COMPOUND 1 | COMPOUND 1 | PRESENT INVENTION |
| 10 | COMPOUND 1 | COMPOUND 1 | COMPOUND 1 | COMPOUND 1 | —※ | PRESENT INVENTION |
| 11 | COMPARATIVE COMPOUND 1 | COMPARATIVE COMPOUND 1 | COMPARATIVE COMPOUND 2 | NO PROCESS | NO PROCESS | COMPARTIVE EXAMPLE |
| 12 | COMPARATIVE COMPOUND 3 | COMPARATIVE COMPOUND 3 | COMPARATIVE COMPOUND 3 | NO PROCESS | NO PROCESS | COMPARTIVE EXAMPLE |
| 13 | COMPARATIVE COMPOUND 4 | COMPARATIVE COMPOUND 4 | COMPARATIVE COMPOUND 4 | NO PROCESS | NO PROCESS | COMPARTIVE EXAMPLE |

DISPERSION OF MOLD RELEASING AGENT·※: A PROCESS FOR SEPARATELY PREPARING A DISPERSION SOLUTION CONTAINING A MOLD RELEASING AGENT IN THE PRESENCE OF A SURFACTANT.
—※: A SYSTEM USING NO SURFACTANT IN THE PROCESS.

TABLE 2

| TONER | NUMBER AVERAGE PARTICLE SIZE(μm) | SHAPE FACTOR: 1.2~1.6 (%) | SHAPE FACTOR: COEFFICIENT OF VARIATION (%) | ROUND PARTICLE (%) | COEFFICIENT OF VARIATION FOR NUMBER DISTRIBUTION (%) |
|---|---|---|---|---|---|
| 1 | 4.2 | 65.8 | 15.8 | 61 | 18.4 |
| 2 | 5.1 | 65.1 | 15.2 | 63 | 19.2 |
| 3 | 5.2 | 65.7 | 15.4 | 52 | 22.2 |
| 4 | 6.2 | 68.4 | 15.1 | 64 | 21.1 |
| 5 | 5.8 | 67.5 | 16.5 | 55 | 26.7 |
| 6 | 6.5 | 66.4 | 14.8 | 55 | 21.2 |
| 7 | 7.6 | 71.2 | 30.5 | 24 | 19.1 |
| 8 | 5.2 | 72.3 | 14.2 | 59 | 26.2 |
| 9 | 5.7 | 69.5 | 15.4 | 58 | 25.4 |
| 10 | 6.2 | 66.5 | 15.8 | 55 | 25.8 |
| 11 | 5.7 | 71.2 | 15.7 | 51 | 25.1 |
| 12 | 5.4 | 67.5 | 14.5 | 53 | 24.1 |
| 13 | 4.7 | 66.4 | 14.9 | 52 | 26.2 |

<<Evaluation Criteria>>

The obtained electrostatic charge image developing toners 1 to 10 (present invention) and comparative electrostatic charge image developing toners 11 to 13 were used for image formation on a modified model of DocuColor 6060 (product of Fuji Xerox Co., Ltd.), a commercial digital color image formation apparatus (development conditions tuned as being adapted to the individual toners and developing agents), and image was evaluated for the item below.

To make sure, all of the developing vessels and toner supplying devices provided for four colors were charged with the same developing agent and toner, respectively. The developing agent was prepared using the individual toners and carriers shown in the exemplary manufacture described below.

(Exemplary Fabrication of Carrier)

One hundred parts by mass of 50 μm manganese/magnesium ferrite particle was subjected to dry coating using 3 parts by mass of cyclohexyl methacrylate-butyl methacrylate copolymer (ratio of copolymerization of 40:60), to thereby obtain a carrier for the toner of the present invention.

<<Evaluated Items>>

The individual toners were evaluated for their stereographic expression of image, transparency of image, filming of photosensitive material, environmental difference in charging, skin washability, rise-up property of charging and stability of charging.

<<Stereographic Expression of Image>>

A sample image of undersea photograph of coral reef was printed using the individual toners, and stereographic expression of the image was visually evaluated. Evaluation of the stereographic expression was most convenient when the cyan toner was used.

A: Excellent (almost comparable to printing by an ink jet printer);

B: Good (comparable to or better than offset printing, and an excellent level of electrophotographic system); and C: No good (level only equivalent to color electrophotographic system of the former generation).

<<Transparency of Image>>

Transparent image (OHP image) was prepared using the individual toners, and evaluated according to the method below. Amount of adhesion of the toner was evaluated within a range of 0.7±0.05 (mg/cm$^2$). Visible spectral transmissivity of the fixed image was measured using Model 330 self-recording spectrophotometer, manufactured by Hitachi Ltd., in reference to an OHP sheet having no toner carried thereon, where difference between spectral transmissivity at 650 nm and 450 nm was used as an index of transmissivity of the OHP image for yellow toner, difference between transmissivity at 650 nm and 550 nm for magenta toner, and difference between transmissivity at 500 nm and 600 nm for cyan toner. The transmissivity was judged as desirable when this value is 90% or above.

A: 95% or above (almost comparable to printing by an ink jet printer);

B: not less than 90% and less than 95% (excellent level of electrophotographic system); and D: less than 90% (level only equivalent to color electrophotographic system of the former generation).

In the present invention, A and B are practically allowable.

<<Filming of Photosensitive Material>>

Unsharpness of the image (unreadable print of 8-point Ming-type Kanji character, or image bleeding) was visually observed, and ranked as below.

A: observed on less than 5 sheets out of one million sheets (good);

B: observed on 6 to 20 sheets out of one million sheets (practically allowable); and D: observed on not less than 21 sheets out of one million sheets (practically not allowable).

In the present invention, A and B are practically allowable.

<<Environmental Difference in Charging>>

In a 20-ml glass container, 19 g of a carrier and 1 g of the toner are placed, shaken at a frequency of 200 swings/min and an angle of swinging of 45°, using a 50-cm arm for 20 minutes in two types of environment shown below (low-temperature-low-humidity environment, and high-temperature-high-humidity environment), and the amount of electrostatic charging was measured by the blow-off technique.

Low-temperature-low-humidity environment: adjusted to 10° C., 10% RH

High-temperature-high-humidity environment: adjusted to 30° C., 85% RH

Charging was ranked as below based on difference between amounts of charging in the low-temperature-low-humidity environment and in the high-temperature-high-humidity environment.

A: Less than 2 μC/g (excellent)

B: not less than 2 μC/g and less than 8 μC/g (good)

C: not less than 8 μC/g and less than 12 μC/g (practically allowable)

D: not less than 12 μC/g (practically not allowable)

<<Evaluation of Skin Washability>>

Washability of the toner after contact and adhesion to the skin (hands, legs, etc.) was ranked as below.

A: Stain removable only by washing with running water without using a soap (excellent);

B: Stain readily removable using a soap (good); and

D: Color slightly remains even after washing with a soap (practically not allowable).

In the present invention, A and B are practically allowable.

<<Rise-up of Electrostatic Charging and Stability of Charging>>

In a small-sized developing vessel with a developing sleeve having a diameter as small as ϕ10 mm, 100 g of the developing agent was set, and 10 g of the toner was supplied to the developing vessel. The developing vessel in its entirety was stirred, and continued until the amount of charging reached a maximum value. Degree of lowering of the amount of charging was also measured by continuing the stirring for 120 minutes without exchanging the toner from the start of the stirring. The amount of charging was measured by the publicly-known blow-off technique.

A: Maximum value of electrostatic charging reached within a time shorter than 15 seconds, and lowering in the amount of charging after 120 minutes less than 5 μC/g (excellent);

B: Maximum value of electrostatic charging reached within a time not shorter than 15 seconds and shorter than 35 seconds, and lowering in the amount of charging after 120 minutes not less than 5 μC/g and less than 10 μC/g (good);

C: Maximum value of electrostatic charging reached within a time not shorter than 35 seconds and shorter than 50 seconds, and lowering in the amount of charging after 120 minutes not less than 10 μC/g and less than 15 μc/g (practically allowable); and D: Maximum value of electrostatic charging reached within a time not shorter than 50 seconds, and lowering in the amount of charging after 120 minutes not less than 15 μC/g (no good).

Results are shown in Table 3.

TABLE 3

| TONER | STEREOGRAPHIC EXPRESSION OF IMAGE | TRANS-PARENCY OF IMAGE | FILMING OF PHOTOSENSITIVE MATERIAL | ENVIRONMENTAL DIFFERENCE IN CHARGING | SKIN WASHABILITY | RISE-UP PROPERTY AND STABILITY OF CHARGING | REMARKS |
|---|---|---|---|---|---|---|---|
| 1 | A | A | A | A | A | A | PRESENT INVENTION |
| 2 | A | B | A | B | A | A | PRESENT INVENTION |
| 3 | B | B | A | A | A | A | PRESENT INVENTION |
| 4 | B | B | A | A | B | A | PRESENT INVENTION |
| 5 | A | A | B | A | B | A | PRESENT INVENTION |
| 6 | B | B | B | A | B | A | PRESENT INVENTION |

TABLE 3-continued

| TONER | STEREOGRAPHIC EXPRESSION OF IMAGE | TRANS-PARENCY OF IMAGE | FILMING OF PHOTOSENSITIVE MATERIAL | ENVIRONMENTAL DIFFERENCE IN CHARGING | SKIN WASHABILITY | RISE-UP PROPERTY AND STABILITY OF CHARGING | REMARKS |
|---|---|---|---|---|---|---|---|
| 7 | A | A | A | A | A | A | PRESENT INVENTION |
| 8 | A | A | A | B | A | A | PRESENT INVENTION |
| 9 | B | A | A | A | A | A | PRESENT INVENTION |
| 10 | B | B | A | B | A | A | PRESENT INVENTION |
| 11 | D | D | B | C | D | C | COMPARTIVE EXAMPLE |
| 12 | D | D | D | C | D | C | COMPARTIVE EXAMPLE |
| 13 | D | D | D | D | D | C | COMPARTIVE EXAMPLE |

It is known from Table 3 that, as compared with the earlier developed toner, the electrostatic charge image developing toner of the present invention is excellent in stereographic expression of image, transparency of image, not causative of filming of the photo-sensitive material, less environmental difference in charging, always showing a sharp distribution of amount of charge irrespective of moisture environment, excellent in handleability in the maintenance, and excellent in rise-up and stability of charging.

The entire disclosure of Japanese Patent Applications No. Tokugan 2003-184447 which was filed on Jun. 27, 2003, including specification, claims, drawings and summary are incorporated herein by reference in its entirety.

What is claimed is:

1. An electrostatic charge image developing toner comprising:

a toner particle having a colorant and a resin; and a surfactant having two or more anionic groups within one molecule in an amount of 10 ppm to 10,000 ppm.

2. The toner of claim 1, wherein any one of the anionic groups comprises a sulfonic acid group or a salt of the sulfonic acid group.

3. The toner of claim 1, wherein a coefficient of variation of shape factor of the particle is 16% or less, and a coefficient of variation of number-average particle diameter is 27% or less.

4. The toner of claim 1, wherein the surfactant comprises a compound expressed by a general formula (1):

General formula (1)

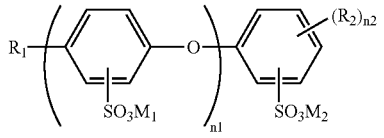

in the general formula (1), $R_1$ represents a $C_{8-12}$ alkyl group, $R_2$ represents a hydrogen atom or substituent, $M_1$ and $M_2$ respectively represent a monovalent metal element or ammonium ion, n1 is an integer of 1 to 6, and n2 is an integer of 1 to 4.

5. An electrostatic charge image developing toner comprising:

a toner particle having a colorant and a resin; and a surfactant having two or more anionic groups within one molecule in an amount of 10 ppm to 10,000 ppm, wherein the surfactant comprises a compound expressed by a general formula (2):

General formula (2)

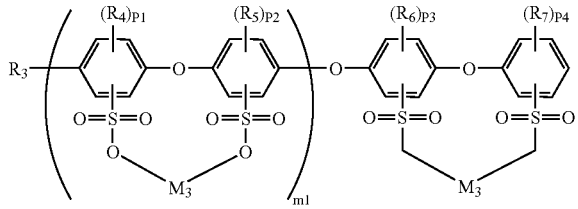

in the general formula (2), $R_3$ represents a $C_{8-12}$ alkyl group, $R_4$, $R_5$, $R_6$, and $R_7$, respectively represent a hydrogen atom or substituent, m1 is an integer of 1 to 5, $M_3$ and $M_4$ respectively represent a divalent metal element, p1 to p3 respectively represent an integer of 1 to 3, and p4 is an integer of 1 to 4.

6. The toner of claim 1, wherein the surfactant comprises compound 2:

Compound 2

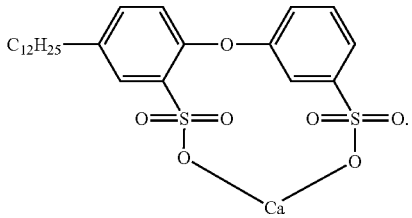

7. The toner of claim 1, wherein the surfactant comprises compound 4:

Compound 4

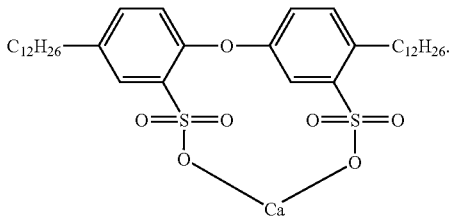

* * * * *